US007818984B2

(12) United States Patent
Hwang

(10) Patent No.: US 7,818,984 B2
(45) Date of Patent: Oct. 26, 2010

(54) DOOR LOCKING APPARATUS

(75) Inventor: Moon Sung Hwang, Seoul (KR)

(73) Assignee: Keicho Hightech, Inc., Seoul (KR)

( * ) Notice: Subject to any disclaimer, the term of this patent is extended or adjusted under 35 U.S.C. 154(b) by 577 days.

(21) Appl. No.: 11/802,905

(22) Filed: May 25, 2007

(65) Prior Publication Data

US 2008/0127686 A1 Jun. 5, 2008

(30) Foreign Application Priority Data

Nov. 30, 2006 (KR) ..... 10-2006-0119564

(51) Int. Cl.
*E05B 47/00* (2006.01)

(52) U.S. Cl. ..... 70/107; 70/92; 70/218; 70/222; 70/276; 70/278.7; 70/279.1; 70/465; 70/472; 292/21; 292/39; 292/92; 292/336.3; 292/DIG. 27

(58) Field of Classification Search ..... 70/188, 70/189, 472, 422, 149, 218, 222, 278.7, 280, 70/92, 465, 276, 413, 107–111, 277, 278.1, 70/279.1; 292/21, 39, 92, DIG. 27, 336.3, 292/DIG. 61

See application file for complete search history.

(56) References Cited

U.S. PATENT DOCUMENTS 4,633,687 A * 1/1987 Fane ..... 70/276
4,956,984 A * 9/1990 Chi-Cheng ..... 70/277
4,979,383 A * 12/1990 Tully ..... 70/107
4,995,248 A * 2/1991 Liu ..... 70/107
5,027,629 A * 7/1991 Liu ..... 70/277
5,291,766 A * 3/1994 Eisermann ..... 70/276
5,546,778 A * 8/1996 Eisermann ..... 70/276
5,653,134 A * 8/1997 Lee et al. ..... 70/276
5,987,945 A * 11/1999 Ruano Aramburu ..... 70/277
6,286,345 B1 * 9/2001 Kim et al. ..... 70/189
7,080,533 B2 * 7/2006 Sedley ..... 70/276
2001/0027670 A1 * 10/2001 Sakai et al. ..... 70/276

FOREIGN PATENT DOCUMENTS

KR 1020030024046 3/2003
KR 10-0399168 9/2003

* cited by examiner

*Primary Examiner*—Lloyd A Gall
(74) *Attorney, Agent, or Firm*—Robert E. Bushnell, Esq.

(57) ABSTRACT

An electronic door locking apparatus having a mortise lock including dead bolt and latch bolt installed therein, which is able to easily open a door from the outside by inserting a metal card having a magnet installed inside if a power source such as a dry battery is not supplied or if the locking apparatus is not useable due to other mechanical defects, and also able to perform a lock function since a dead bolt is locked if a door handle of an outer unit is rotated upwards when there are defects in a driving motor or electronic components. The door locking apparatus includes: a mortise lock having a dead bolt extended and retracted by a driving force of a motor installed in the inner unit in order to lock/unlock a door, and a door locking/unlocking latch bolt operated by the door handles of the inner and outer units; a latch bolt driver for operating the latch bolt; a dead bolt driver for operating the dead bolt; an emergency release assembly installed inside the outer unit and engaged with the door handle of the outer unit in order to unlock the locked dead bolt; and an emergency card inserted into the emergency release assembly to unlock the dead bolt.

18 Claims, 25 Drawing Sheets

DOOR LOCKING APPARATUS

CLAIM OF PRIORITY

This application makes reference to, incorporates the same herein, and claims all benefits accruing under 35 U.S.C. §119 from an application earlier filed in the Korean Intellectual Property Office on Nov. 30, 2006 and there duly assigned Serial No. 10-2006-0119564.

BACKGROUND OF THE INVENTION

1. Field of the Invention

The present invention relates to an electronic door locking apparatus having a mortise lock installed therein, the mortise lock including a dead bolt and a latch bolt, and more particularly to an electronic door locking apparatus including a keypad, a fingerprint recognition device and a card reader, which can easily open a door from the outside by inserting a metal card having a magnet installed inside if a power source such as a dry battery is not supplied or if the locking apparatus is unusable due to other mechanical defects, and can also perform a lock function since a dead bolt is locked if a door handle of an outer unit is rotated upwards when there are defects in a driving motor or electronic components.

2. Description of the Prior Art

Locking apparatuses such as door locks may be divided into mechanical apparatus, electrical apparatus and electronic apparatus, depending on their operation systems. Here, the mechanical apparatus is configured so that it can be manually locked and unlocked, the electrical apparatus is configured so that it can be automatically locked and unlocked using a solenoid, a motor, etc., and the electronic locking apparatus serves to determine locking and unlocking states using a keypad, a fingerprint recognition device, a card reader, etc. In recent years, the electronic locking apparatus has been increasingly used due to its easy usage and reliable security.

Such an electronic locking apparatus is a system in which electronically performs the certification procedure of visitors, and the actual locking and unlocking of a locker mechanism corresponding to the mortise lock and the like is mechanically performed by the key locking apparatus. Accordingly, the key locking apparatus should be effectively operated since it is connected to electronic parts (certification parts and a locker mechanism) when unlocking (or locking) the locking mechanism.

However, a variety of the door locking apparatuses using such a mortise lock do not satisfactorily play a role as the locking apparatus or is easily damaged due to its complex configuration and instability in its operation between components if it is used for an extended time.

Generally, most of the door locking apparatuses include a latch bolt for locking and unlocking a door while popping in or out using an operation mechanism provided with a rotation means such as door handles which are each installed inside or outside the door.

In order to prevent the instability in locking the door using a latch bolt, the door locking apparatuses also include a dead bolt operating means bolt for locking and unlocking a door while popping a dead bolt in or out using an operation mechanism provided with a rotation means such as a rotation knob, or a key rotation means such as a card key reader module, regardless of the operation mechanism of the latch bolt.

There is a mortise lock having a dual locking system of a latch bolt and a dead bolt, which is widely used for such a door locking apparatus. For example, Korean Patent No. 399168 issued by this applicant discloses a door locking apparatus separately composed of a dead bolt and a latch bolt and having a function of automatically locking the dead bolt (an auto re-lock dead bolt).

In the case of the door locking apparatus, a door may be freely opened by users inside the door, while it may be opened from the outside only by authorized persons. Also, convenience of the users was accommodated since the user can open the door without requesting help of the authorized persons inside the door by opening a door from the outside using a remote controller.

However, the door locking apparatus may be configured using electrical components such as solenoid so that the authorized person outside a door can open the door. That is to say, there is no choice but to depend on components that can be electrically operated, such as solenoid, so as to open the door from the outside if the door is opened by employing a user recognition system such as an RF card reader, and a remote controller.

Accordingly, the electrical components have a problem in that the authorized user outside the door never opens the door without help from a person inside the door when power is not supplied since the electrical components are operated only when they are connected to an internal power source or an external power source.

Also, if a door handle of an outer unit includes a separate cylinder key, a door may be damaged by drilling outside the door when one forcibly opens the door, and therefore it is uneconomical since the entire door locking apparatus may be replaced.

That is to say, conventional electronic door locks are automatically opened using a password, a card and a fingerprint, and automatically locked when the door is closed, but have a problem in that they cannot perform a crime prevention function since it functions as a locking apparatus while one is out because its dead bolt is not locked if a motor or electronic and mechanical parts are out of order.

Also, the door is automatically closed by operation of the motor while one is out, and the dead bolt is not interlocked by the keypad since an emergency, such as a fire, melts the electronic components, and it is therefore difficult to bring the fire under control.

SUMMARY OF THE INVENTION

Accordingly, the present invention is designed to solve such drawbacks of the prior art, and therefore an object of the present invention is to provide an electronic door locking apparatus capable of easily opening a door from the outside by inserting a metal card, which has a magnet installed inside, into an emergency release assembly if a power source such as a dry battery is not supplied or when the locking apparatus is not useable due to other mechanical defects.

Another object of the present invention is to provide a door locking apparatus capable of performing a lock function since a dead bolt is locked if a door handle of an outer unit is rotated upwards when there are defects in a driving motor or electronic components.

Still another object of the present invention is to provide a door locking apparatus capable of performing a perfect crime prevention function since the door is automatically opened by means of the card and the fingerprint and locked when the door is closed, but the door may be manually locked by turning a hand grip upwards in the worst case where there are defects in the electronic parts or the mechanical parts.

Yet another object of the present invention is to provide a door locking apparatus capable of ensuring safety in opening the door by employing a mechanical connection system regardless of automatically opening the door with a barium ferrite emergency card, other than a key, into which magnetic data is inputted, regardless of the components burned or melted in the emergency such as a fire since the door is not opened by the motor but mechanically opened in a one-touch system by an operation of a lever along with the latch bolt and the dead bolt while one is out.

One embodiment of the present invention is achieved by providing a door locking apparatus having an inner unit having a door handle and installed in one side of a door, and an outer unit installed in the other side of the door corresponding to the inner unit and having a door handle, the door locking apparatus including a mortise lock having a dead bolt extended and contracted by a driving force of a motor installed in the inner unit in order to lock/unlock a door, and a door locking/unlocking latch bolt operated by the door handles of the inner and outer units; a latch bolt driver for operating the latch bolt; a dead bolt driver for operating the dead bolt; an emergency release assembly installed inside the outer unit and engaged with the door handle of the outer unit in order to unlock the locked dead bolt when the motor is inoprative; and an emergency card inserted into the emergency release assembly to unlock the dead bolt.

The mortise lock used in the present invention preferably opens/closes the latch bolt; the mortise lock includes a latch driving slider having a groove slid when the door handles of the inner and outer units are independently rotated and receiving a rotation lever, and a shoulder portion for driving a link member; a link member engaged with the latch driving slider to operate the latch bolt so as to open/close a door; an elastic member to supply a restoring force to the latch driving slider when operated by the link member; a drive plate connected with the latch bolt; and a pin fixed to the drive plate and associated with one end of the link member.

Also, the mortise lock preferably further includes a rotation lever having a hole into which a pivot of a plunger is inserted so that it is rotated together when rotating the motor installed in the inner unit, and a dead bolt transfer arm; a dead bolt drive plate for fixing a dead bolt in its one end and having guide slots, and a reception notch unit receiving the dead bolt transfer arm; and an elastic member for driving the dead bolt drive plate when operating the transfer arm.

Meanwhile, the outer unit preferably includes a housing having the rotation driver of the door handle inserted thereinto and including a groove formed therein, wherein the groove defines a swivel angle of the door handle, and the groove for inserting an elastic member supplies a restoring force to the door handle and being integrally formed therein.

And, the inner unit preferably includes a housing having the rotation driver of the door handle inserted thereinto and including a groove and a fixed clamp plate, wherein the groove defines a swivel angle of the door handle, the groove for inserting an elastic member to supply a restoring force to the door handle, and the fixed clamp plate having two projections formed therein, the projections defining a swivel angle of the plunger.

The latch bolt driver includes a disk having a first projection, two second projections and a rectangular through hole formed in its central protrusion and including a pinhole into which the locking pin is inserted; the first projection is fixed in the rotation driver of the outer unit and associated between both ends of the elastic member to determine a swivel angle of the door handle, the second projections pushing a lift plate upwards when rotating the door handle; and a lift plate including a protruded plate to ascend/descend in a vertical direction by the second projections when rotating the disk in order to push a slider of the mortise lock.

In the present invention, the dead bolt driver preferably includes a rotary moving body coupled to a central protrusion of the disk, prevented from being rotated when the latch bolt driver is operated by the door handle of the outer unit and rotated at a predetermined angle in a left or right direction when the dead bolt is locked and unlocked, and including horizontal wings and a vertical groove to which the projected portion of the revolving body driving pin of the inner unit is coupled; a plunger including a pivot having a shoulder portion and a rectangular section for rotating the rotary moving body or preventing the rotary moving body from being rotated if it is inserted into the rectangular through hole of the disk to rotate the door handle; a key revolving body having a groove and two projections formed therein, wherein the pivot of the plunger rotated by the motor of the inner unit when opening/closing the door is inserted into the groove through the hole of the mortise lock; a pair of revolving body driving sliders having protruded plates associated respectively with the horizontal wings of the rotary moving body when locking and unlocking the dead bolt; and a pair of elastic members for providing a restoring force to the revolving body driving slider.

Meanwhile, the inner unit preferably includes a disk having a projection and a rectangular hole formed in its central protrusion, wherein the projection is fixed in the rotation driver and associated between both ends of the elastic member to determine a swivel angle of the door handle; a rotary moving body driving pin having a projected portion and a rectangular projection; the projected portion is rotated together when rotating the disk and inserted into the vertical groove formed in the rotary moving body of the outer unit to operate the latch bolt and the dead bolt by operating the lift plate and the rotating body driving slider of the outer unit when rotating the door handle, and the rectangular projection is inserted into the rectangular hole of the disk; and a plunger for rotating a pair of gears and a rotation lever of the mortise lock together to lock and unlock the dead bolt the gears are rotated by receiving a driving force of the motor, and the rotation lever is fixed in the gear to rotate and counter-rotate the dead bolt at a predetermined angle.

The plunger preferably includes a stopper for defining a swivel angle of the plunger in a space between the two projections of the fixed clamp plate.

Meanwhile, the emergency release assembly preferably includes a body including an opening for inserting an emergency card and a reception groove and fixed in the housing of the outer unit; upper/lower plates for easily inserting the emergency card inserted into the opening of the body; an elastic plate for resiliently supporting the upper/lower plates against the body; a magnet-fixed clamp plate installed onto the upper plates and having through holes for receiving a plurality of cylindrical magnets, formed therein; a first slider having a plurality of grooves and a spring reception groove formed therein and being able to be slid by the emergency card, the grooves corresponding to the through holes of the magnet-fixed clamp plate; a plurality of magnets arranged between the magnet-fixed clamp plate and the first slider to permit the first slider to move only when a valid emergency card is inserted since it is operated by means of an impact and a repulsion of the emergency card when inserting the emergency card; a cover fixed in the body to receive the upper/lower plates, the elastic plate, the magnet-fixed clamp plate, the first slider and the magnets into the reception groove of the body, and simultaneously fixed in the housing and having an opening; a second slider fixed in the first slider through the opening of the cover and slid to give a bias force so that the rotary moving body and the plunger are rotated together; and a rod and a spring being able to be inserted into the reception groove to supply a restoring force to the first slider.

And, it is characterized in that a through hole for receiving a locking pin and a spring is formed in the rotary moving body of the outer unit; and the rotary moving body is rotated together with the plunger when the second slider moves forwards, and the rotary moving body allows the plunger of the inner unit to rotate the rotation lever of the mortise lock by operating the rotating body driving slider to rotate the key rotating body, to manually unlock the dead bolt.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein:

FIG. 11*a* is a plane view showing the outer unit illustrating that the dead bolt is retracted to unlock the door lock apparatus and the latch bolt is extended.

FIG. 11*b* is a plane view showing the outer unit illustrating that a key rotating body is rotated to extend the dead bolt of the mortise lock outwards when an external force is applied upward from a door handle of the outer unit, thereby locking the door lock apparatus, and simultaneously the latch bolt is retracted inwards by means of the latch bolt push rod.

FIG. 11*c* is a plane view showing the outer unit illustrating that the latch bolt is retracted outwards when the external force applied to the door handle is cancelled under the condition as shown in FIG. 11*b*.

FIG. 11*d* is a plane view showing the outer unit illustrating that the key rotating body is not rotated to the door lock apparatus continuously even when the external force is applied downwards from the door handle of the outer unit under the condition as shown in FIG. 11*c*, and simultaneously the latch bolt is retracted inwards by means of the latch bolt push rod.

FIG. 12*a* is a plane view showing the outer unit and the mortise lock illustrating that the dead bolt is retracted to unlock the door lock apparatus and the latch bolt is extended outwards;

FIG. 12*b* is a plane view showing the outer unit and the mortise lock illustrating that a key rotating body is rotated to extrude a dead bolt of a mortise lock outwards when an external force is applied upward from a door handle of the outer unit, thereby locking the door lock apparatus, and simultaneously the latch bolt is retracted inwards by means of the latch bolt push rod.

FIG. 12*c* is a plane view showing the outer unit and the mortise lock illustrating that the latch bolt is extended outwards when the external force applied to the door handle is cancelled under the condition as shown in FIG. 12*b*.

FIG. 12*d* is a plane view showing the outer unit and the mortise lock illustrating that only a plunger is rotated but the key rotating body is not rotated when the door handle is rotated under the condition as shown in FIG. 12*c*, and therefore the dead bolt is continuously locked since the key rotating body is not rotated.

DETAILED DESCRIPTION OF THE INVENTION

Figure 1:
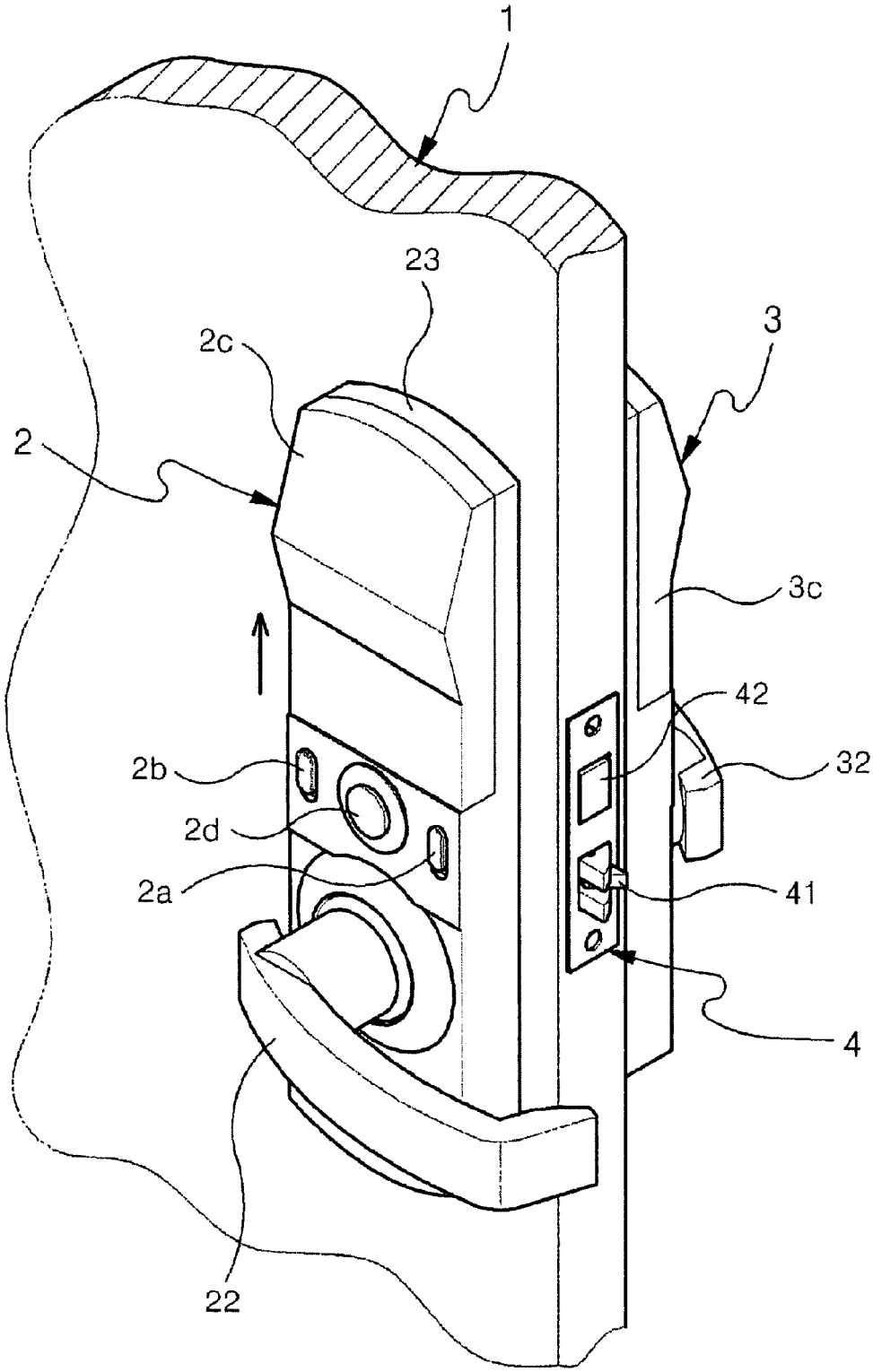
FIG. 1 is a perspective view showing installation of a door locking apparatus according to one embodiment of the present invention.

Hereinafter, embodiments according to the present invention will be described with reference to the accompanying drawings. Here, when one element is connected to another element, one element may be not only directly connected to another element but also indirectly connected to another element via another element. Furthermore, irrelevant elements have been omitted for clarity. Also, like reference numerals refer to like elements throughout.

Referring to FIG. 1, the door locking apparatus of the present invention includes an inner unit 2 installed on one side of a door; and an outer unit 3 installed on the other side of the door 1 corresponding to the inner unit 2, wherein the inner and outer units 2,3 include door handles 22, 32, respectively. And, the mortise lock 4 including a latch bolt 41 and a dead bolt 42 mounted inside the door 1.

In the inner unit 2 and the outer unit 3 according to the present invention, nearly all components except for an insulator are preferably manufactured with strong metal structures that are resistant to fire and external damages, and particularly preferably manufactured so that the inner unit 2 and the outer unit 3 can have high strength and purity of a natural zinc surface appearance using a zinc die casting material and process.

Figure 2:
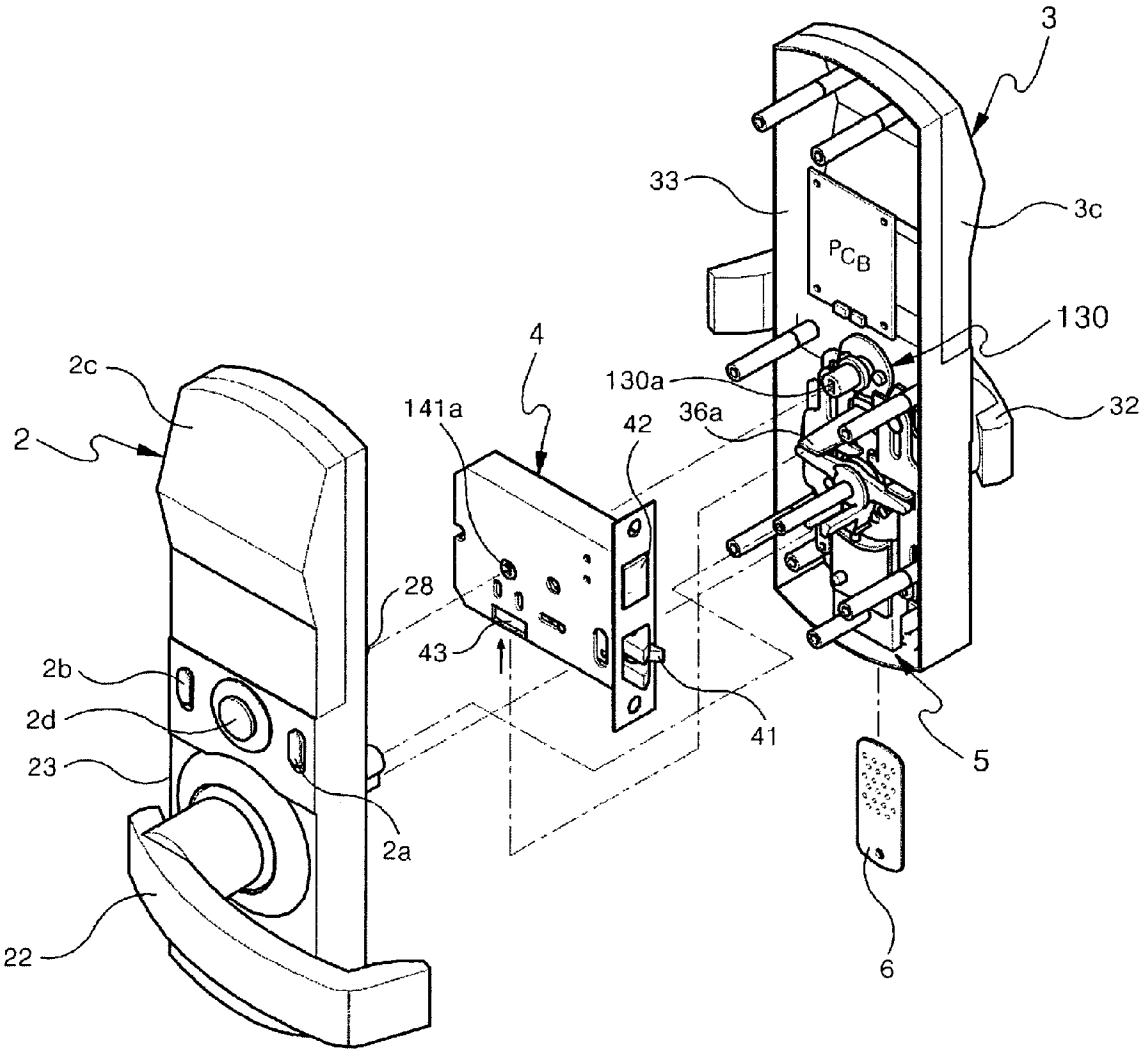
FIG. 2 is an exploded perspective view showing a door locking apparatus according to an embodiment of the present invention.

Meanwhile, the mortise lock 4 used in the present invention includes a door locking/unlocking latch bolt 41 operated by means of door handles 22, 32 of the inner unit 2 and the outer unit 3; and a dead bolt 42 extended and retracted by means of a driving force of a motor 21 installed in the inner unit 2 to lock/unlock a door. Accordingly, the mortise lock 4 used in the present invention has a different configuration from conventional mortise locks. That is to say, a slider 43 for driving the latch bolt 41 is operated by means of a protruded plate 36*a* of a lift plate 36 configured in the outer unit 3 since the slider 43 is arranged in a lower part of the mortise lock 4, as shown in FIG. 2 (see FIG. 3*a* and FIG. 3*b*).

Figure 4:
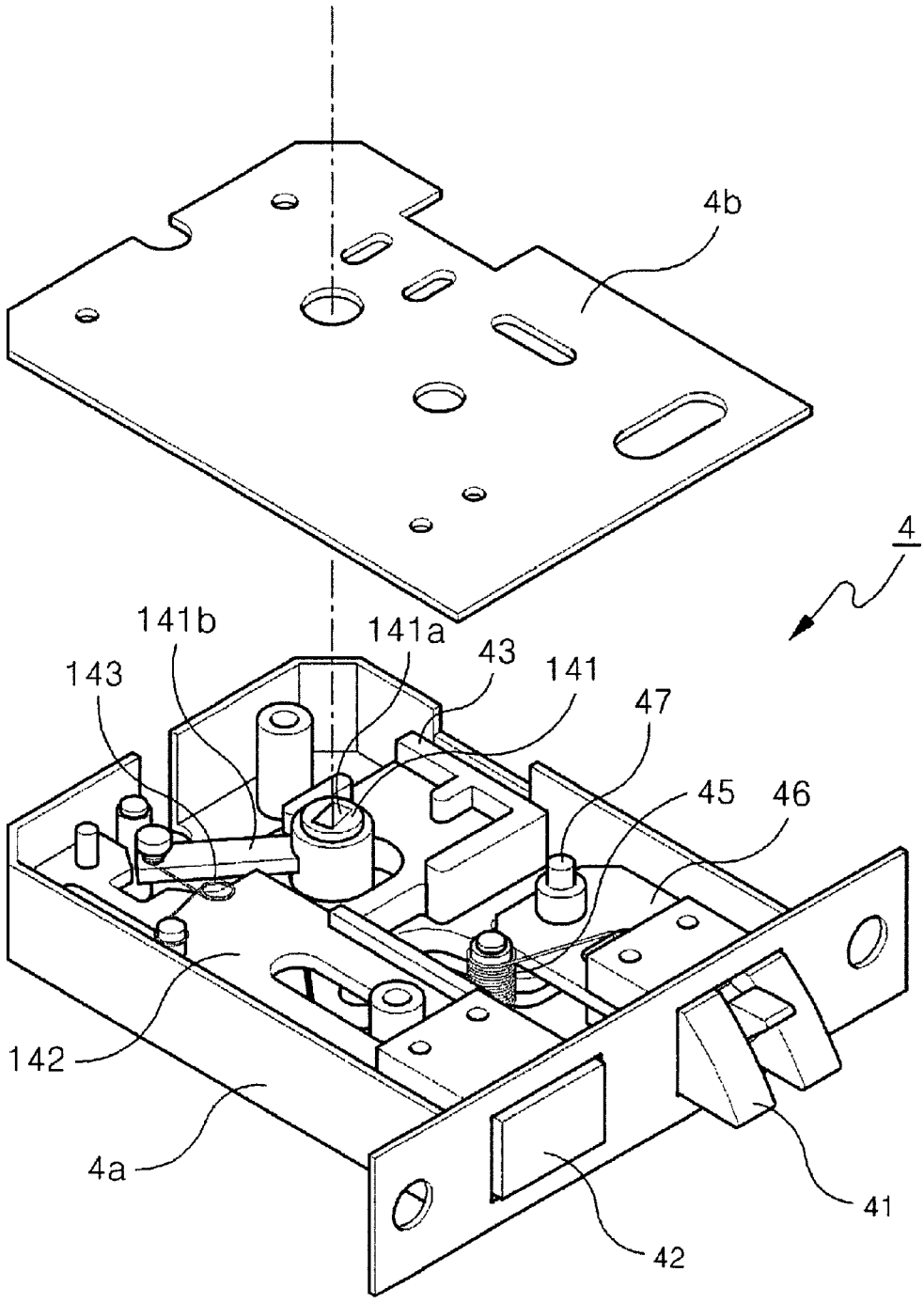
FIG. 4 is an exploded perspective view showing a cover of the mortise lock used in an embodiment of the present invention.
Figure 5:
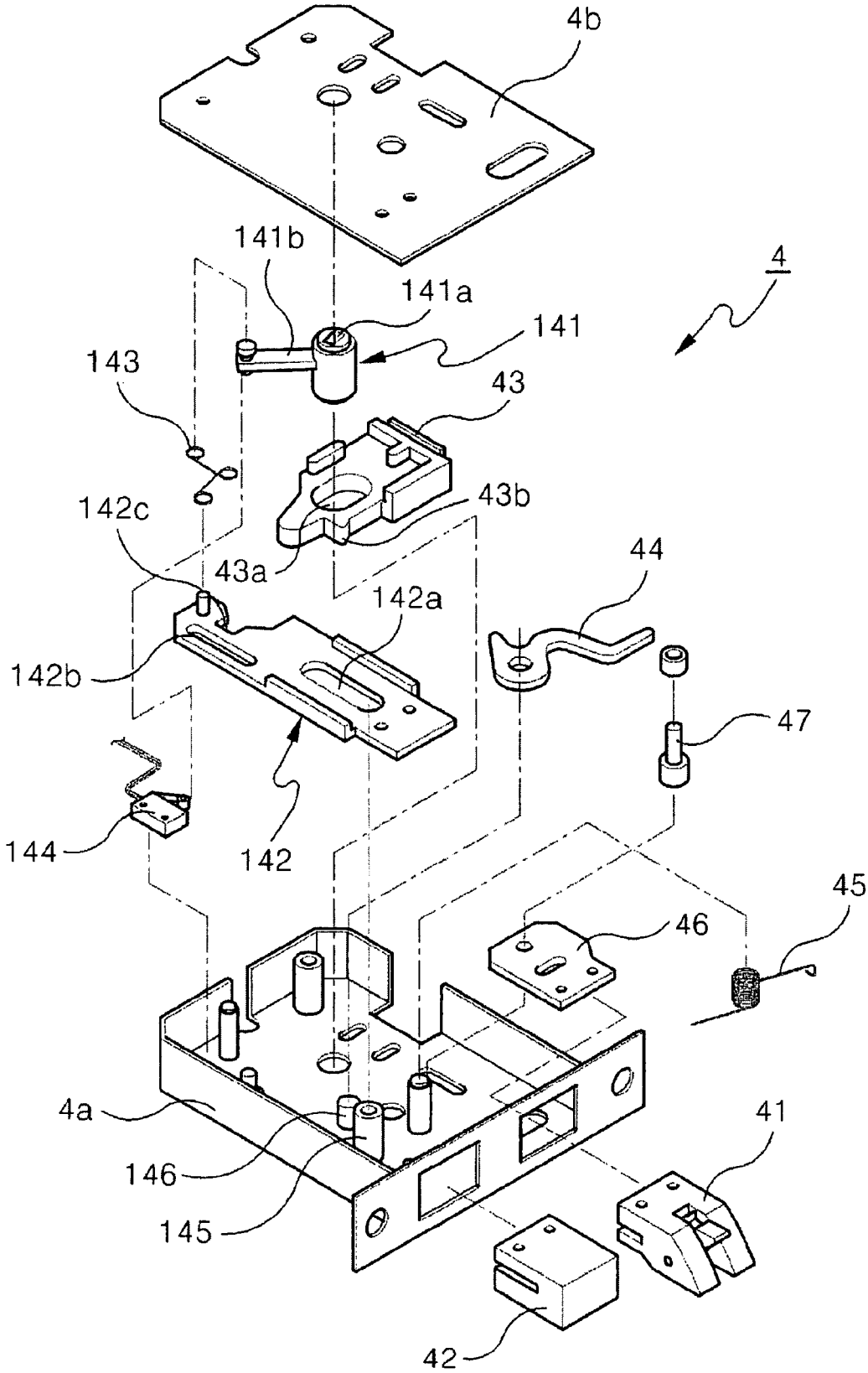
FIG. 5 is an exploded perspective view showing the mortise lock as shown in FIG. 4.

Referring to FIG. 4 and FIG. 5, the mortise lock 4 includes a housing 4*a* and a lid 4*b*. Then, a latch driving slider 43 is installed inside the housing 4*a*, the latch driving slider 43 including a groove 43*a* slid when the door handles 22, 32 of the inner and outer units 2, 3 are rotated independently and receiving a rotation lever 141; and a shoulder portion 43*b* for driving a link member 44.

As shown in FIG. 5, a link member 44 and an elastic member 45 are installed inside the housing 4*a*, wherein the link member 44 is engaged with the latch driving slider 43 to operate the latch bolt 41, to thereby open/close a door, and the elastic member 45 serves to give elasticity to the latch driving slider 43 when it is operated by the link member 44. Then, the elastic member 45 is shown as a torsion spring, but the other kinds of springs may also be used herein.

And, the elastic member 45 includes a drive plate 46 into which the latch bolt 41 is fixed; and a pin 47 fixed in the drive plate 46 and associated with one end of the link member 44, to open/close the latch bolt 41.

Meanwhile, the mortise lock 4 further includes a rotation lever 141 having a hole 141*a* through which a pivot of the plunger 28 (see FIG. 8) is passed so that it can be rotated together when a motor 21 installed in the inner unit 2 is rotated, and a dead bolt transfer arm 141*b*; a dead bolt drive plate 142 having a dead bolt 42 fixed in its one end and receiving guide slot 142*a*,142*b* and a dead bolt transfer arm 141*b*; and a spring as an elastic member 143 for resiliently driving the dead bolt drive plate 142 when operating the transfer arm 141*b*, and also include a switch 144 for providing a forward and backward movement of the dead bolt drive plate 142 to a controller apparatus which is installed in a printed circuit board (PCB) inside the outer unit 3, which will be described later, wherein a guide rod 145 is fixed in the guide slot 142*a*.

Figure 8:
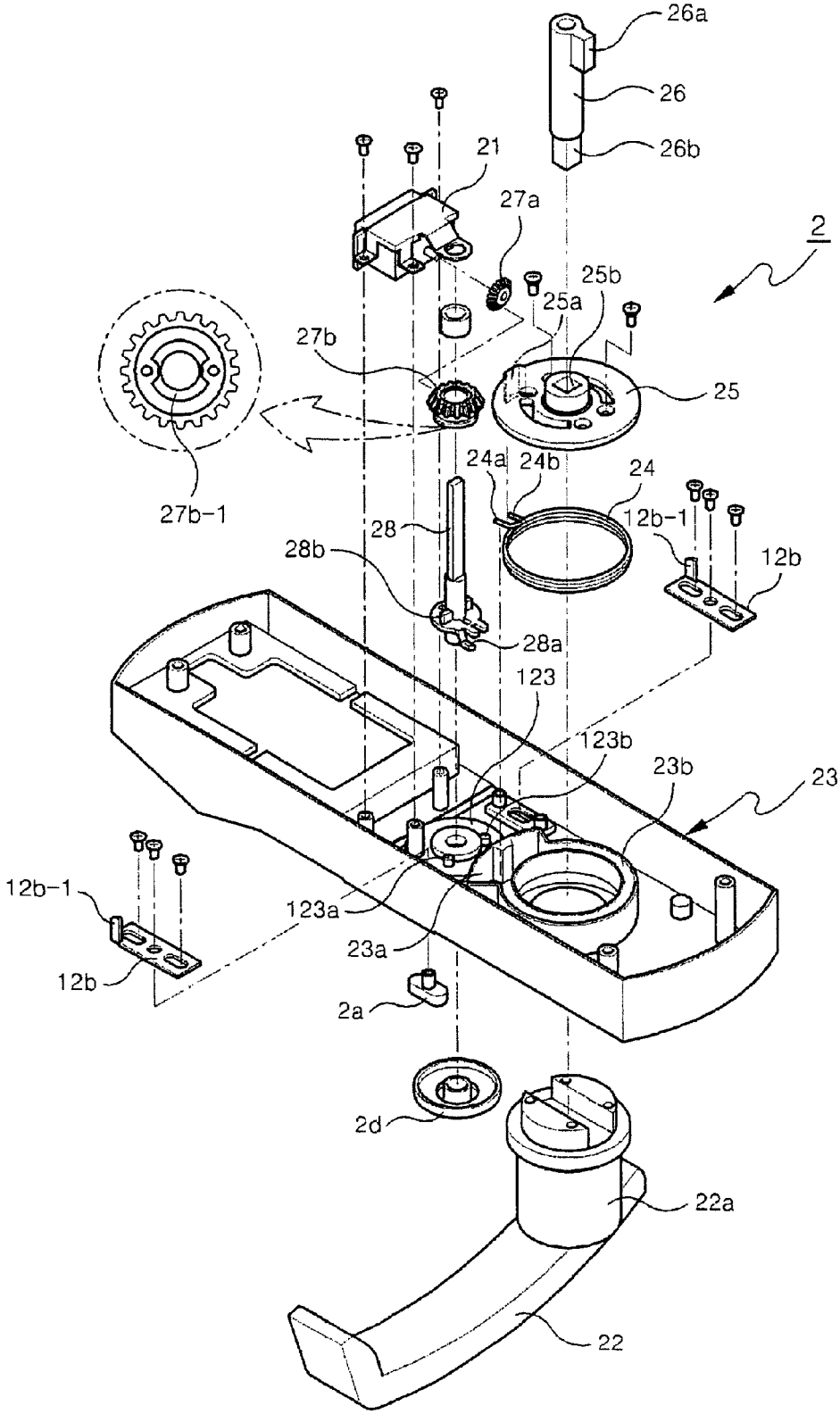
FIG. 8 is an exploded perspective view showing the inner unit as shown in FIG. 6.

Referring to FIG. 8, the inner unit 2 has a rotation driver 22*a* of the door handle 22 inserted thereinto, and has housing 23 formed therein, wherein the housing 23 includes a groove 23*a* for defining a swivel angle of the door handle 22, a groove 23*b* for inserting a elastic member 24, and a housing 23 having a fixed clamp plate 123 formed therein, the groove 23*b* giving elasticity to the door handle 22, and the fixed clamp plate 123 including two projections 123*a*, 123*b* for defining a swivel angle of the plunger 28.

Figure 7:
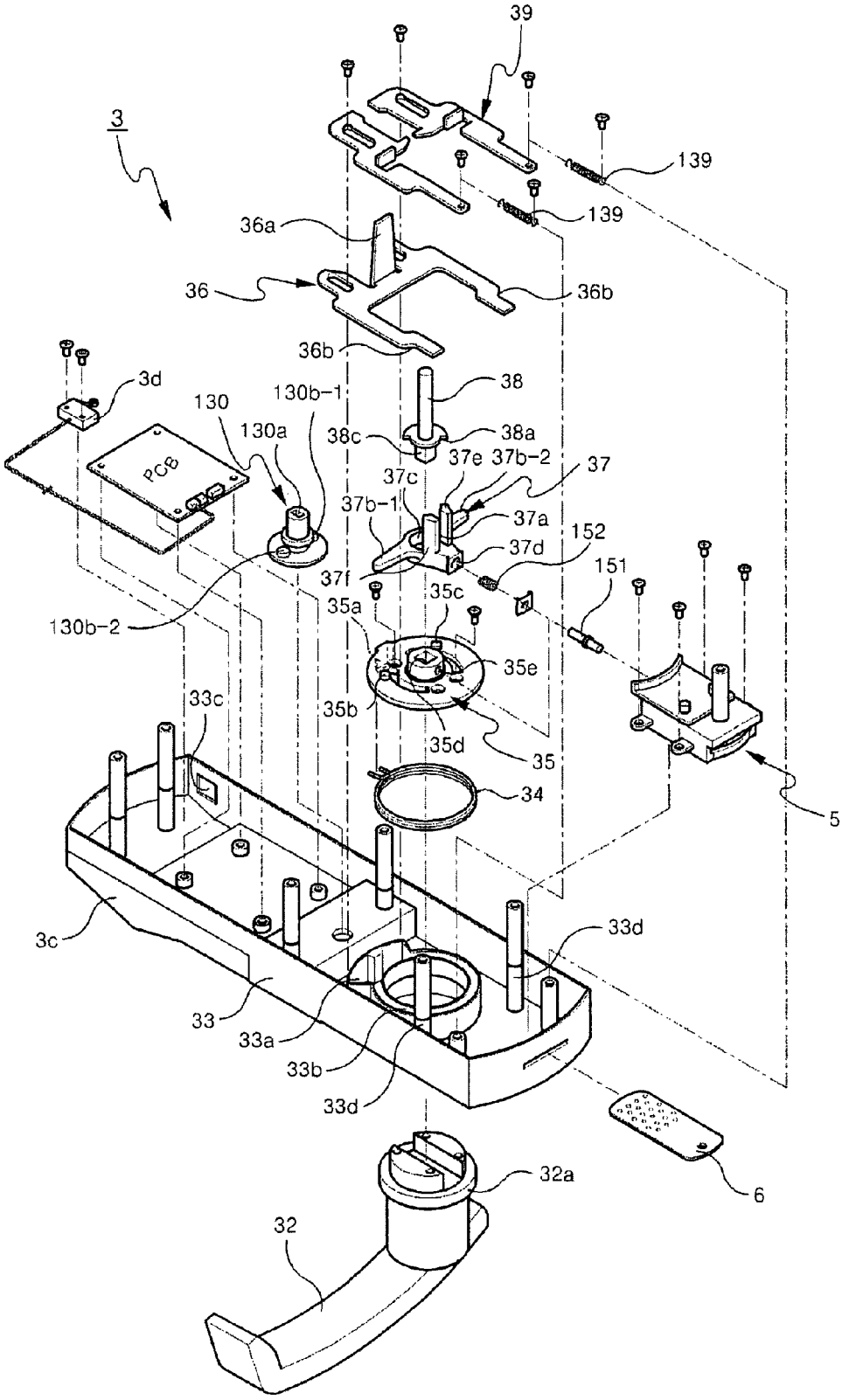
FIG. 7 is an exploded perspective view showing an outer unit used in an embodiment of the present invention.

Referring to FIG. 7, the outer unit 3 has a rotation driver 32*a* of a door handle 32 inserted thereinto, and includes a housing 33 having a groove 33*a* for defining a swivel angle of the door handle 32; and a groove 33*b* for inserting a elastic member 34 integrally formed therein, wherein the groove 33*b* gives elasticity to the door handle 32.

Meanwhile, the door locking apparatus according to the present invention includes a latch bolt driving means for operating a latch bolt 41; and a dead bolt driving means for operating a dead bolt 42, and will be described in more detail.

Referring to FIG. 7, the latch bolt driver used in the present invention includes a disk 35 and a lift plate 36 for pushing a slider 43 of the mortise lock 4, wherein the disk 35 has a first projection 35*a* fixed in the rotation driver 32*a* of the outer unit 3 and associated between both ends of the elastic member 34 to determines a swivel angle of the door handle 32, two second projections 35*b*, 35*c* for pushing a lift plate 36 when rotating the door handle 32, and a pinhole 35*e* having a rectangular through hole 35*d* formed in a central protrusion and a locking pin 151 inserted thereinto; and the lift plate 36 includes a protruded plate 36*a* being able to be ascended/descended in a vertical direction by means of the second projections 35*b*,35*c* when rotating the disk 35.

And, the dead bolt driver used in the present invention is coupled to the central protrusion of the disk 35, not rotated when the latch bolt driver is operated by the door handle 32 of the outer unit 3 and rotated at a predetermined angle in a clockwise or counterclockwise direction when the dead bolt 42 is locked and unlocked, and includes a rotary moving body 37 coupled to a central protrusion of the disk 35, prevented from being rotated when the latch bolt driver is operated by the door handle 32 of the outer unit 3 and rotated at a predetermined angle in a clockwise or counterclockwise direction when the dead bolt 42 is locked and unlocked, and including horizontal wings 37*b*-1,37*b*-2 and a vertical groove 37*a* to which the projected portion 26*a* of the rotating body driving pin 26 of the inner unit is coupled; a plunger 38 including a pivot having a shoulder portion 38*a* and a rectangular section 38*c* for rotating the rotary moving body 37 or preventing the rotary moving body 37 from being rotated if it is inserted into the rectangular through hole 35*d* of the disk 35 to rotate the door handle 32; a key rotating body 130 having a groove 130*a* and two projections 130*b*-1,130*b*-2 formed therein, wherein the pivot of the plunger 28 rotated by the motor 21 of the inner unit 2 when opening/closing the door is inserted into the groove 130*a* through the hole 141*a* of the mortise lock 4; a pair of rotating body driving sliders 39 having protruded plates 39*a*, 39*b* associated respectively with the horizontal wings 37*b*-1,37*b*-2 of the rotary moving body 37 when locking and unlocking the dead bolt 42; and tensile springs as a pair of elastic members 139 for giving elasticity to the rotating body driving slider 39.

Referring to FIG. 8 again, the inner unit 2 used in the present invention includes a disk 25 having a projection 25*a* and a rectangular hole 25*b* formed in its central protrusion, wherein the projection 25*a* is fixed in the rotation driver 22*a* and associated between both ends of the elastic member 24 to determine a swivel angle of the door handle 22; a rotary moving body driving pin 26 having a projected portion 26*a* and a rectangular projection 26*b*, wherein the projected portion 26*a* is rotated together when rotating the disk 25 and inserted into the vertical groove 37*a* formed in the rotary moving body 37 of the outer unit 3 to operate the latch bolt 41 and the dead bolt 42 by operating the lift plate 36 and the rotating body driving slider 39 of the outer unit 3 when rotating the door handle 22, and the rectangular projection 26*b* is inserted into the rectangular hole 25*b* of the disk 25; and a plunger 28 for rotating a pair of gears 27*a*, 27*b* and a rotation lever 141 of the mortise lock together to lock and unlock the dead bolt 42, wherein the gears 27*a*, 27*b* are rotated by receiving a driving force of the motor 21, and the rotation lever 141 is fixed in the gear 27*b* to rotate and counter-rotate the dead bolt 42 by a predetermined angle.

And, the plunger 28 includes a stopper 28*a* for defining a swivel angle of the plunger 28 in a space between two projections 123*a*, 123*b* of the fixed clamp plate 123, and therefore an end of the plunger 28 is fit into the key groove 130*a* of the key rotating body 130 through the hole 141*a* of the rotation lever 141 of the mortise lock 4 when the plunger 28 is installed in the door 1, as shown in FIG. 2. Accordingly, the rotation lever 141 of the mortise lock 4 may be rotated to lock or unlock the dead bolt 42, and simultaneously the key rotating body 130 may also be rotated if the plunger 28 of the inner unit 2 is rotated as shown in FIG. 2, FIG. 4 and FIG. 8.

Accordingly, the rotation lever 141 of the mortise lock 4 is configured so that it can be rotated by the plunger 28 which is rotated by the motor 21 installed in the inner unit 2, or rotated by the key rotating body 130 installed in the outer unit 3.

Meanwhile, the door locking apparatus of the present invention includes an emergency release assembly capable of inserting a metal card having a magnet installed inside if a power source such as a dry battery is not supplied or if the locking apparatus is not useable due to other mechanical defects. As shown in FIG. 7, the emergency release assembly 5 is mounted inside the outer unit 3, and connected to the door handle 32 of the outer unit 3 in order to unlock the locked dead bolt 42 if a power source supplied to the motor is shut off. Accordingly, the emergency card 6 having a permanent magnet installed inside is inserted into the emergency release assembly 5 to unlock the dead bolt 42.

Figure 9:
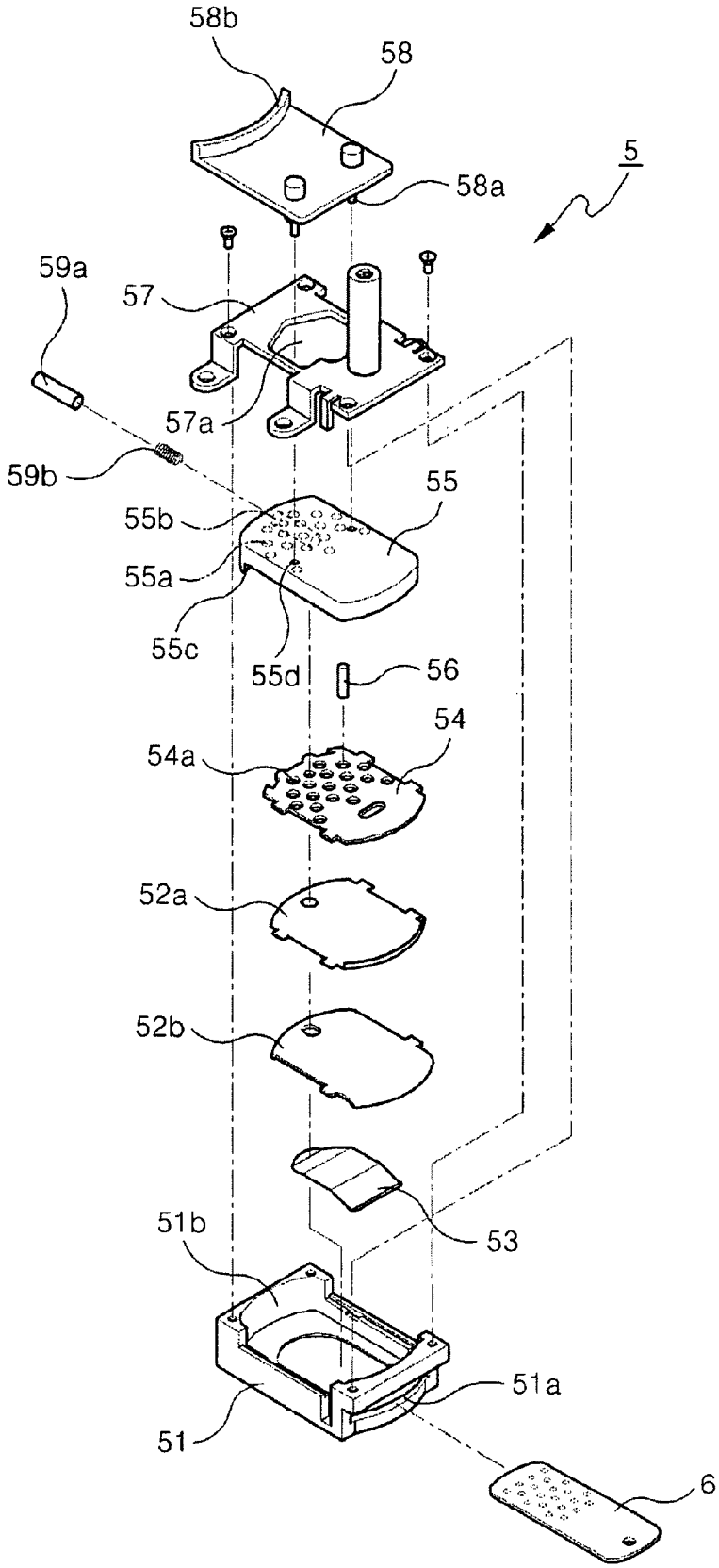
FIG. 9 is an exploded perspective view showing an emergency release assembly as shown in FIG. 7.

Referring to FIG. 9, the emergency release assembly 5 includes a body 51 having an opening 51*a* for inserting an emergency card 6 and a reception groove 51*b* fixed in the housing 33 of the outer unit 3; upper/lower plates 52*a*, 52*b* for easily inserting the emergency card 6 into the opening 51*a* of the body 51; an elastic plate 53 for resiliently supporting the upper/lower plates 52*a*,52*b* against the body 51; and a magnet-fixed clamp plate 54 mounted onto the upper plate 52*a* and including through holes 54*a* for receiving a plurality of cylindrical magnets.

Also, the emergency release assembly 5 includes a first slider 55 having a plurality of cylindrical grooves 55*a* and a spring reception groove 55*b* formed therein and being able to be slid by the emergency card 6, the cylindrical grooves 55*a* corresponding to the through holes 54*a* of the magnet-fixed clamp plate 54; a plurality of magnets 56 arranged between the magnet-fixed clamp plate 54 and the first slider 55 to permit the first slider 55 to move only when a valid emergency card is inserted since it is operated by means of an impact and a repulsion of the emergency card 6 when inserting the emergency card 6; a cover 57 being able to be fixed in the body 51 to receive the upper/lower plates 52*a*,52*b*, the elastic plate 53, the magnet-fixed clamp plate 54, the first slider 55 and the magnets 56 into the reception groove 51*b* of the body 51, and simultaneously fixed in the housing 33 and having an opening 57*a*; and a second slider 58 fixed in the first slider 55 through the opening 57*a* of the cover 57 and slid to give a bias force so that the rotary moving body 37 and the plunger 38 are rotated together.

And, a rod 59*a* is elastically inserted into the reception groove 55*b* using a spring 59*b* in order to give elasticity to the first slider 55.

Referring to FIG. 7 again, a through hole 37*d* for receiving a locking pin 151 and a spring 152 is formed in the rotary moving body 37 of the outer unit 3, and the rotary moving body 37 is rotated together with the plunger 38 when the second slider 58 moves forwards, and the rotary moving body 37 allows the plunger 28 of the inner unit 2 to rotate the rotation lever 141 of the mortise lock 4 by operating the rotating body driving slider 39 to rotate the key rotating body 130, to thereby manually unlock the dead bolt 42.

Figure 10A:
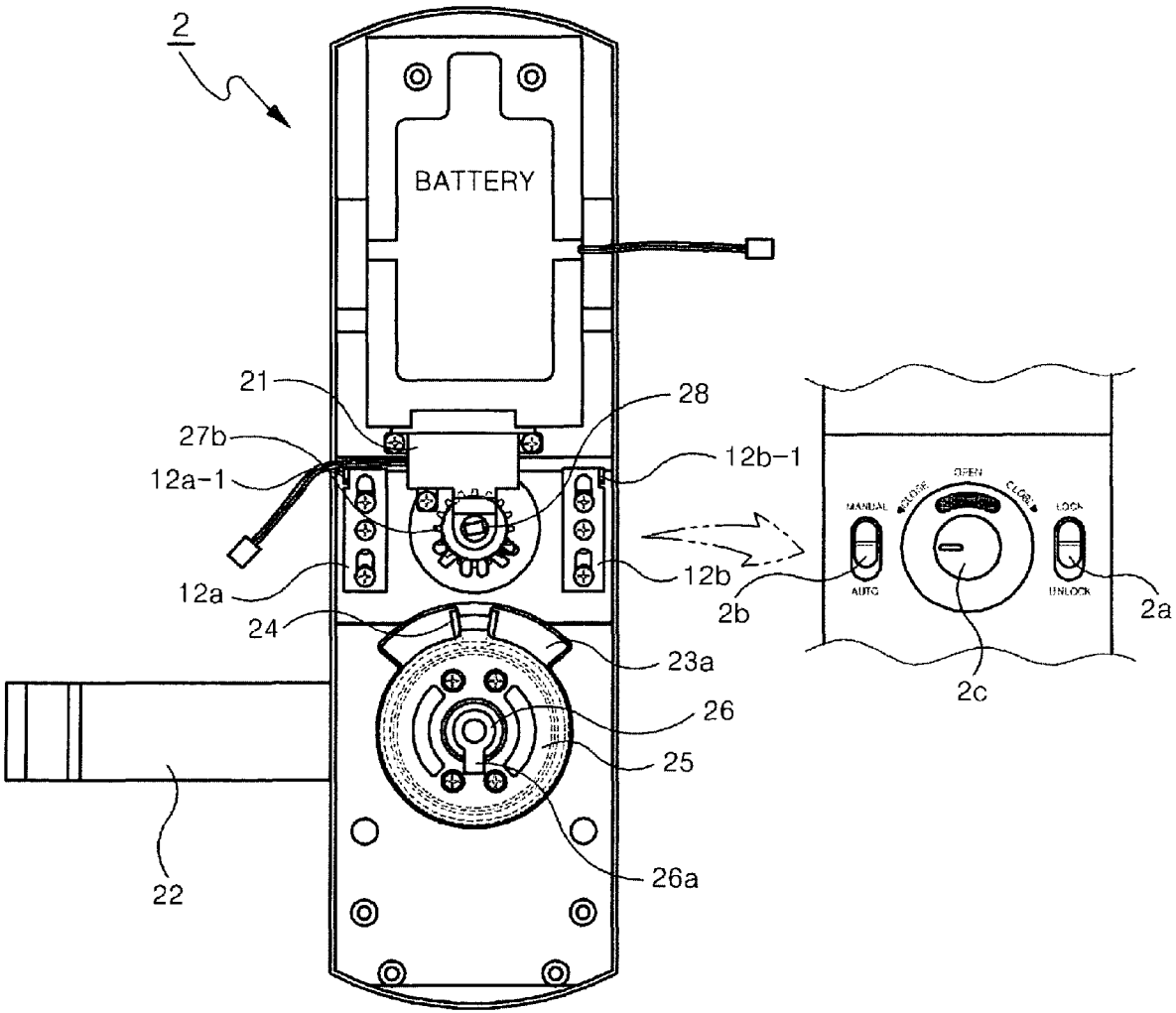
FIG. 10*a* is a plane view showing an outer side of the inner unit.
Figure 10B:
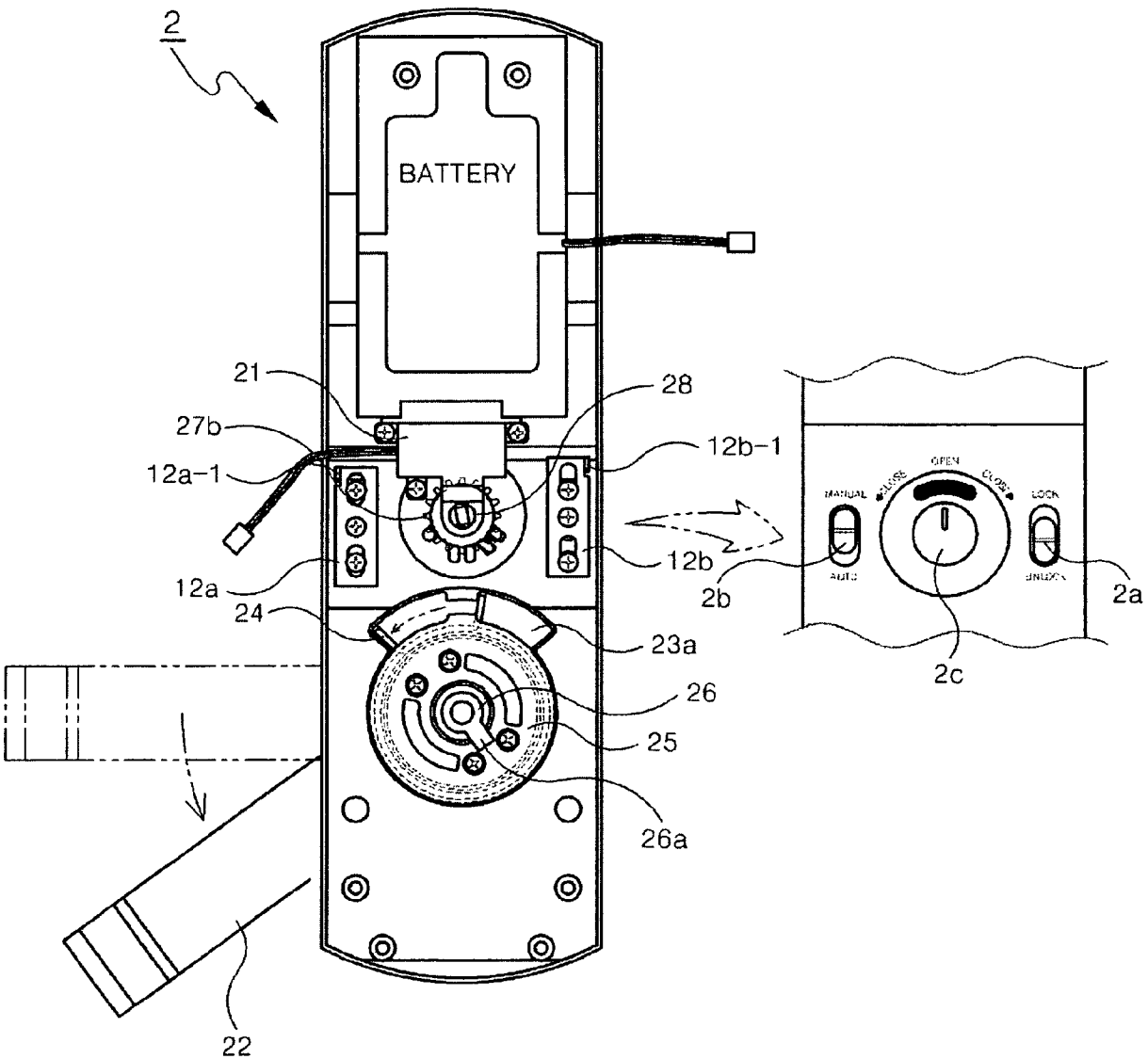
FIG. 10*b* is a plane view showing that a locking state of the dead bolt is cancelled by rotating a rotary grip.

Referring to FIG. 10*a* and FIG. 10*b*, a transfer switch 2*a* for locking and unlocking a door inside a building, a transfer switch 2*b* for operating a door automatically or manually and a cap 2*d* for displaying an operating state of a dead bolt 42 are provided in the inner unit 2, and, referring to FIG. 1, a battery cover 2*c* is provided in the inner unit 2, and therefore a battery may be exchanged by pushing the cover 2*c* upward in an arrow direction.

Figure 3A:
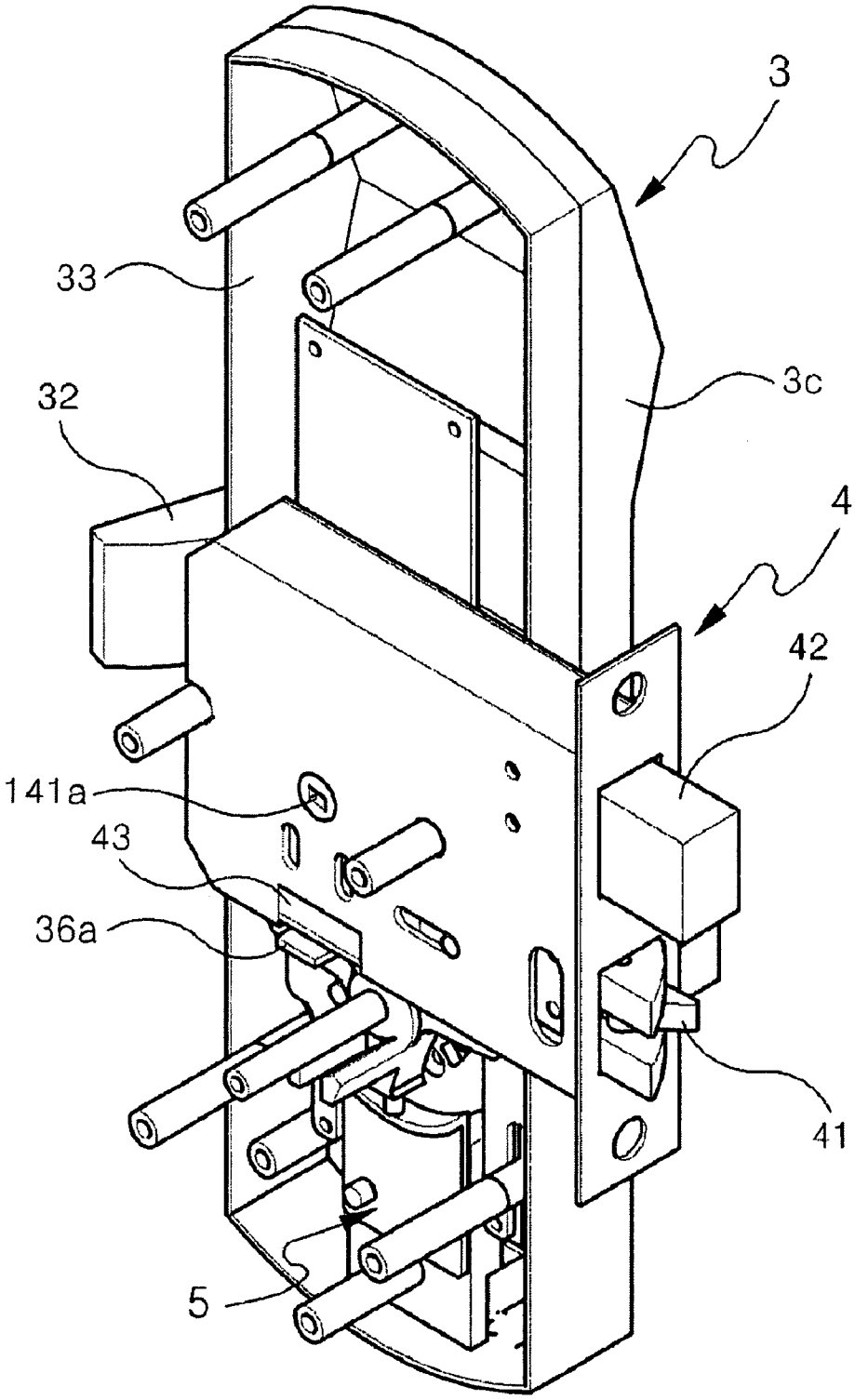
FIG. 3*a* is a perspective view showing that a mortise lock used in the present invention is installed in an outer unit, which illustrates a locking function in which a dead bolt and a latch bolt are extended from the mortise lock.
Figure 3B:
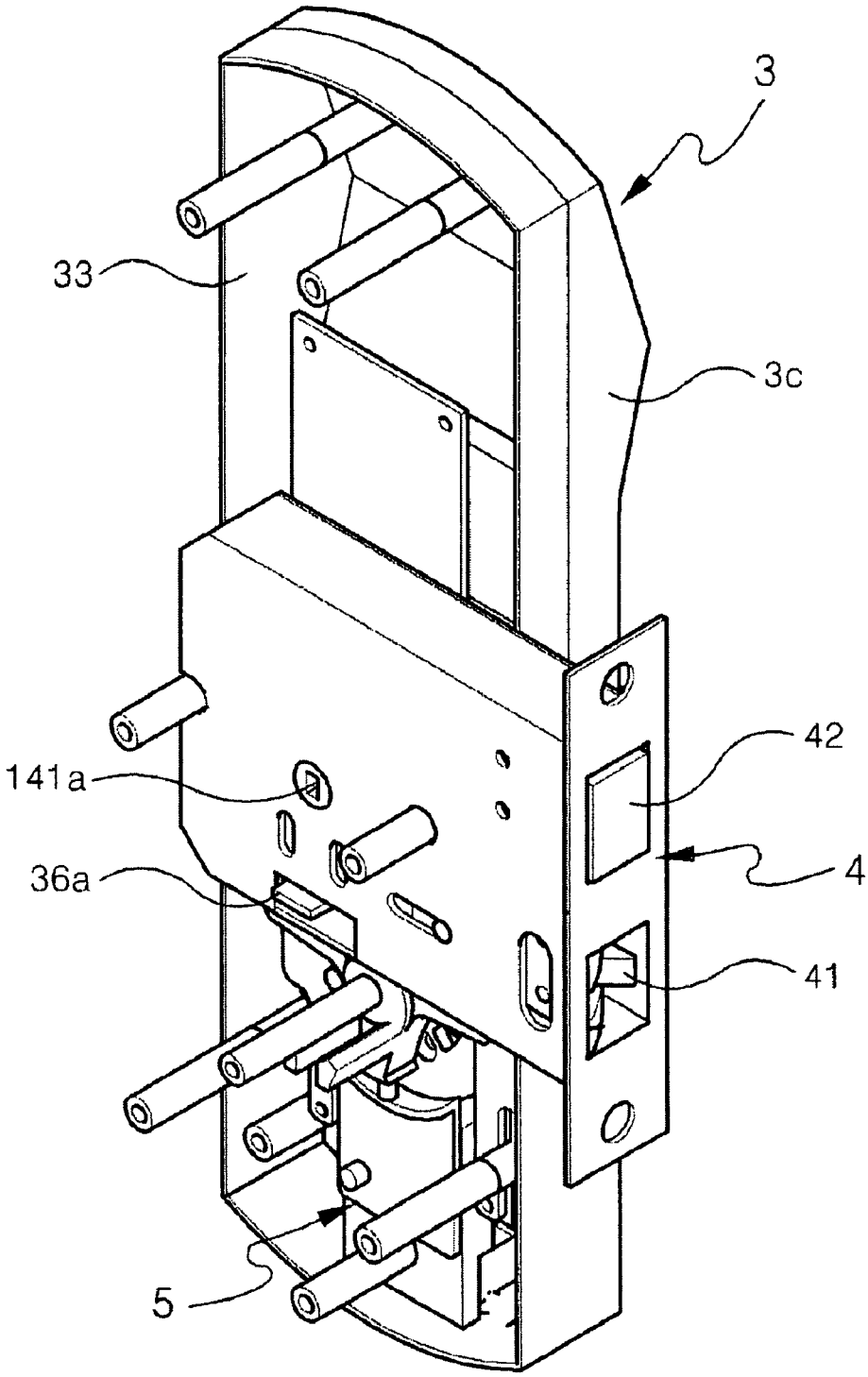
FIG. 3*b* is a perspective view showing that a mortise lock used in an embodiment of the present invention is installed in an outer unit, which illustrates a locking function in which a dead bolt and a latch bolt are retracted inward from the mortise lock at the same time.

Meanwhile, a cover 3*c* is formed in the outer unit 3 as shown in FIG. 3*a* and FIG. 3*b*, and therefore a door may be opened by input of the password since the cover 3*c* has various digital key pads (not shown) as in conventional door locks.

And, a printed circuit board (PCB) is fixed inside the housing 33 of the outer unit 3, wherein electronic circuits for sensing a password or recognizing a fingerprint or recognition circuits using a card reader are installed in the printed circuit board (PCB), as shown in FIG. 7, and an opening 33*c* is formed in one side of the housing 33, wherein a sensor switch 3*d* for sensing an opened state of the cover 3*c* is installed in the opening 33*c*.

Also, referring to FIG. 8, switches 12*a*, 12*b* engaged with transfer switches 2*a*, 2*b* of the housing 23 of the inner unit 2 are slidingly fixed, and projections 12*a*-1,12*b*-1 are formed in the switches 12*a*,12*b*, respectively, and therefore a door allows a sensor switch (not shown) to supply a signal to the printed circuit board (PCB), the signal serving to lock/unlock the door in a manual/automatic manner (see FIG. 7).

And, a groove 27*b*-1 is preferably formed in a lower side of the gear 27*b*, and therefore two projections 28*b* of the plunger 28 slightly flow in the groove 27*b*-1, as shown in the exploded view of FIG. 8.

Meanwhile, in the door locking apparatus of the present invention, a transparent window or a card reader for recognizing a fingerprint may be provided outside the door handle 32 of the outer unit 3 as shown in FIG. 7, or in the housing 23 in order to apply to the door lock having a card recognition means that is operated by the fingerprint recognition means using a fingerprint recognition device and the card reader, and therefore the transparent window or the card reader is omitted for simplification of the drawings in the present invention, but the present invention is not limited thereto.

The door locking apparatus of the present invention configured thus will be described in more detail, and the plane view of the outer unit 3 is shown while excluding some components for convenience' sake in order to clearly describe the operations of the latch bolt 41 and the dead bolt 42.

1. Description of Operation of Latch Bolt for Opening/Closing a Door:

FIG. 11*a* to FIG. 11*d* show plane views showing an operation of components of the outer unit 3 and the mortise lock 4 from which some components have been removed in order to illustrate an operation of a latch bolt for opening/closing a door.

Figure 11A:
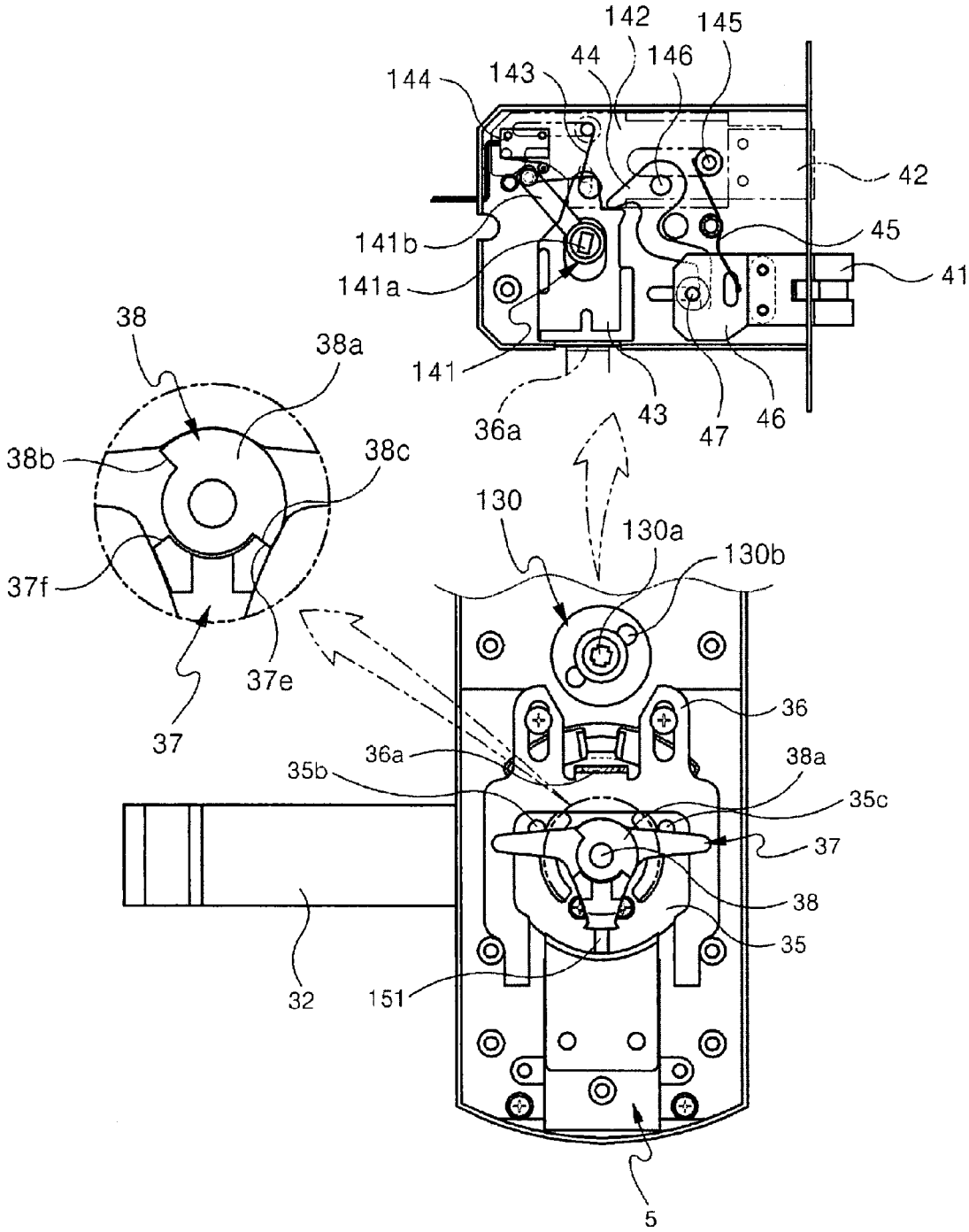
FIG. 11*a* to FIG. 11*d* are plane views showing an operation of components of an outer unit from which some components are removed in order to illustrate an operation of a latch bolt for opening/closing a door.

Referring to FIG. 11*a*, at first, assume that the drawing of FIG. 11*a* is maintained in a beginning state, that is, in a state where a latch bolt 41 is extended, or a dead bolt 42 is unlocked since a door handle 32 of the outer unit 3 is not operated for convenience' sake.

Figure 11B:
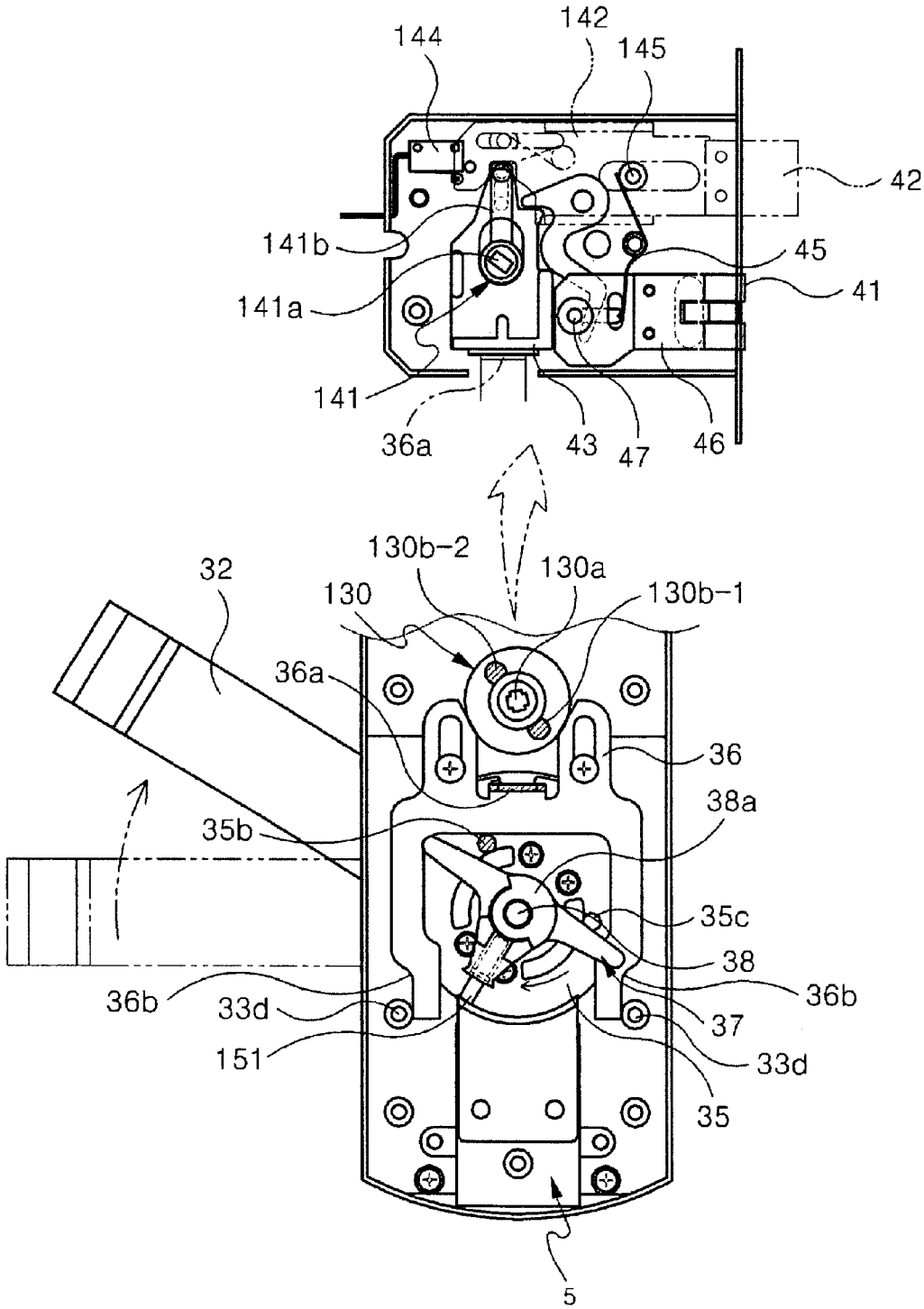

If the door handle 32 is pushed upwards under the condition of FIG. 11*a* as shown in FIG. 11*b* (if the door handle 32 is rotated clockwise as shown in FIG. 11*b*), a disk 35 fixed in a rotation driver 32*a* of the door handle 32 is rotated in an arrow direction. In this case, a first projection 35*a* of the disk 35 as shown in FIG. 7 pushes a free end of an elastic member 34, and a second projection 35*b* of the disk 35 pushes a lift plate 36 upwards, and therefore a protruded plate 36*a* of the lift plate 36 pushes a latch driving slider 43 of the mortise lock 4.

If the latch driving slider 43 is pushed upwards from the condition of FIG. 11*a* as described above, a shoulder portion 43*b* of a slider 43 of the mortise lock 4 pushes one end of a link member 44. Accordingly, the link member 44 is rotated clockwise in the center of a pivot 146, and therefore the other free end of the link member 44 pushes a pin 47 to a left direction, and then a latch bolt 41 is retracted inwards a case of the mortise lock 4, as shown in FIG. 11*b*. As shown in FIG. 11*b*, a dead bolt 42 is extended, but the dead bolt 42 is omitted herein since it will be described later with reference to FIG. 12*b*.

Thus, if the door handle 32 of the outer unit 3 is horizontally pushed upwards (rotated) as shown in FIG. 11*b*, the latch bolt 41 is retracted and the dead bolt 42 may be extended outwards.

However, if a force applied to the door handle 32 is removed when the door handle 32 is pushed upwards as shown in FIG. 11*b*, the free ends of the elastic member 34, which are wide opened as shown in FIG. 7, are contracted, and therefore the first projection 35*a* of the disk 35 is returned to the initial state by means of a restoring force of the free end of the elastic member 34. In this case, the disk 35 is returned to the normal state since it is rotated counterclockwise, as shown in FIG. 11*c*.

If the disk 35 is returned to the normal state as described above, the lift plate 36 moves down by means of a dead weight. At this time, an interfacial portion 36*b* of the lift plate 36 does not further move down since it hangs on a stopper 33*d* formed in the housing 33.

Figure 11C:
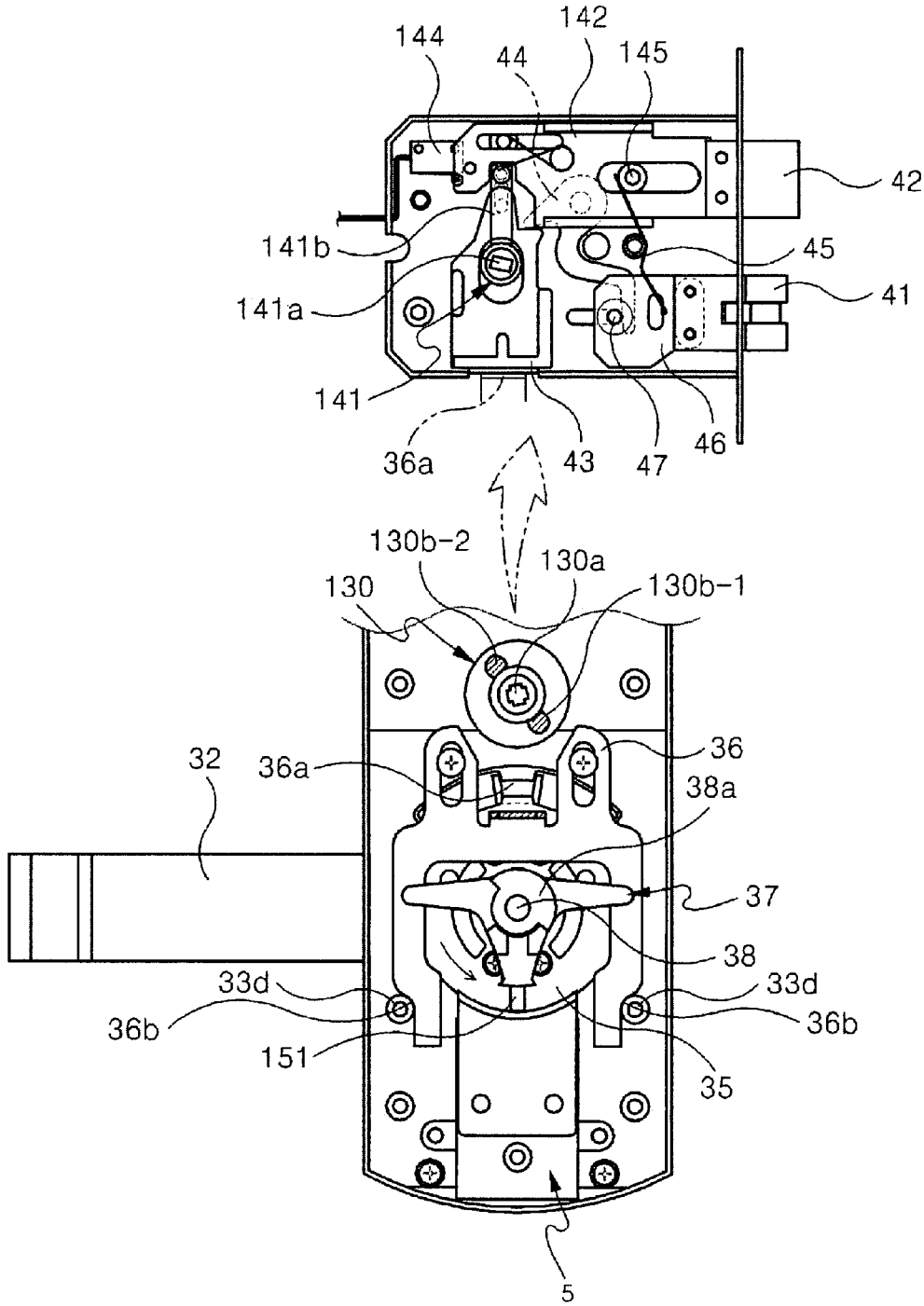

Accordingly, if the disk 35 is returned to the normal state by means of the elastic member 34, the protruded plate 36*a* of the lift plate 36 moves down, and therefore the drive plate 46 of the mortise lock 4 is resiliently operated by means of a restoring force of the elastic member 45, and then the latch bolt 41 is extended inwards the mortise lock 4, thereby to sustain the state of FIG. 11*c*.

However, a locking state of the door locking apparatus is sustained since the rotation lever 141 is not rotated as long as the dead bolt 42 of the mortise lock 4 is forcibly rotated, and this will be described later with reference to FIG. 12*a* to FIG. 12*d*.

Figure 11D:
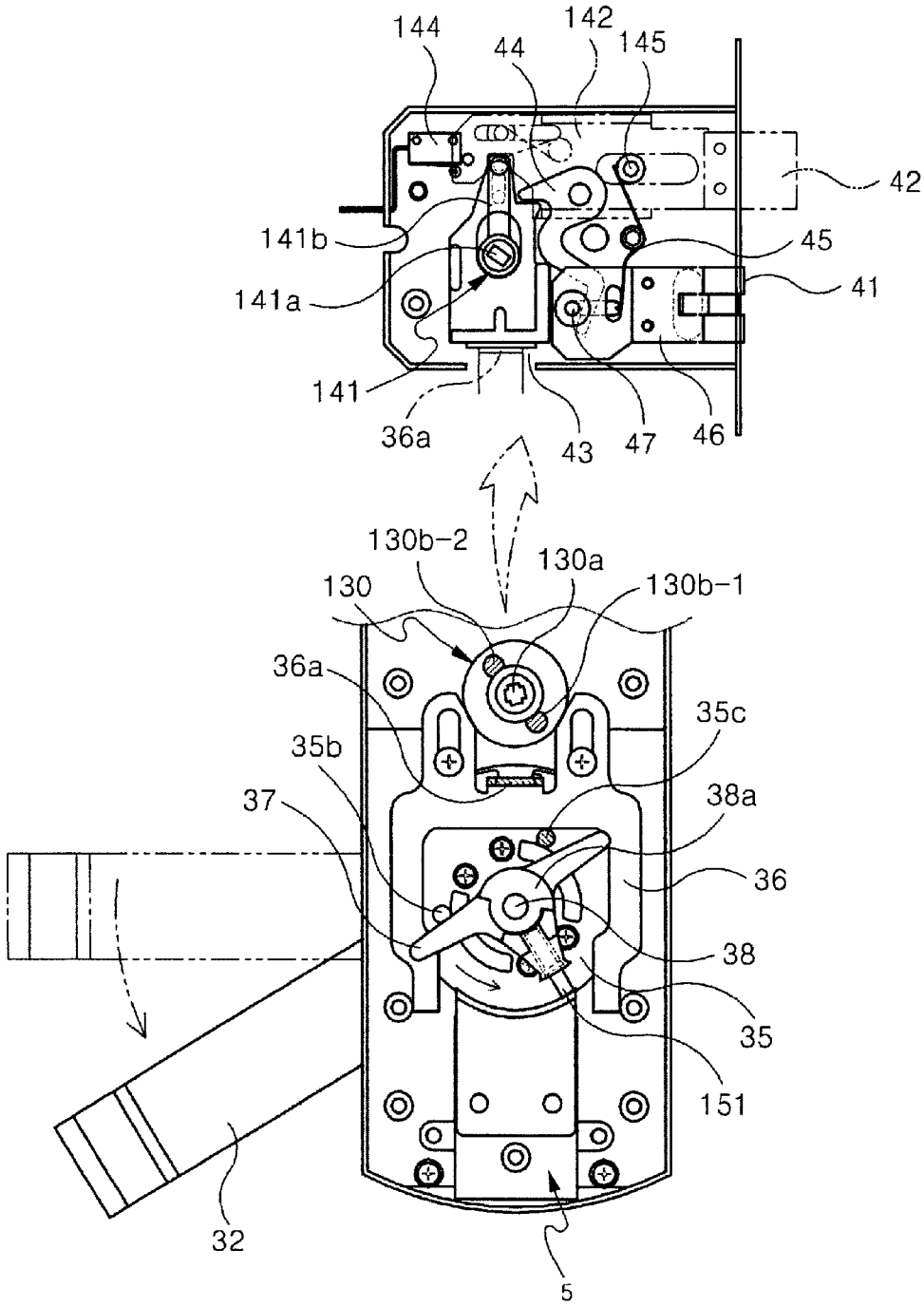

If the door handle 32 moves down under the condition of FIG. 11*c* as shown in FIG. 11*d* (if it is rotated counterclockwise), the disk 35 fixed in the rotation driver 32*a* of the door handle 32 is rotated in an arrow direction. In this case, the first projection 35*a* of the disk 35 as shown in FIG. 7 pushes the other free end of the elastic member 34, and the second projection 35*c* of the disk 35 pushes the lift plate 36 upwards, and therefore the protruded plate 36*a* of the lift plate 36 pushes the latch driving slider 43 of the mortise lock 4.

If the latch driving slider 43 is pushed upwards from the condition of FIG. 11*c* as described above, the shoulder portion 43*b* of the slider 43 of the mortise lock 4 pushes one end of the link member 44. Accordingly, the link member 44 is rotated clockwise in the center of the pivot 146, and therefore the other free end of the link member 44 pushes the pin 47 in a left direction. Therefore, the latch bolt 41 is retracted inwards a case of the mortise lock 4, as shown in FIG. 11*d*.

If a force applied to the door handle 32 is removed form the condition of FIG. 11*d*, the door handle 32 is returned to the normal state again, as described above with reference to FIG. 11*c*.

If the door handle 32 of the outer unit 3 is operated up and down as described above (if it is rotated clockwise or counterclockwise), only the latch bolt 41 is locked and unlocked.

Figure 12A:
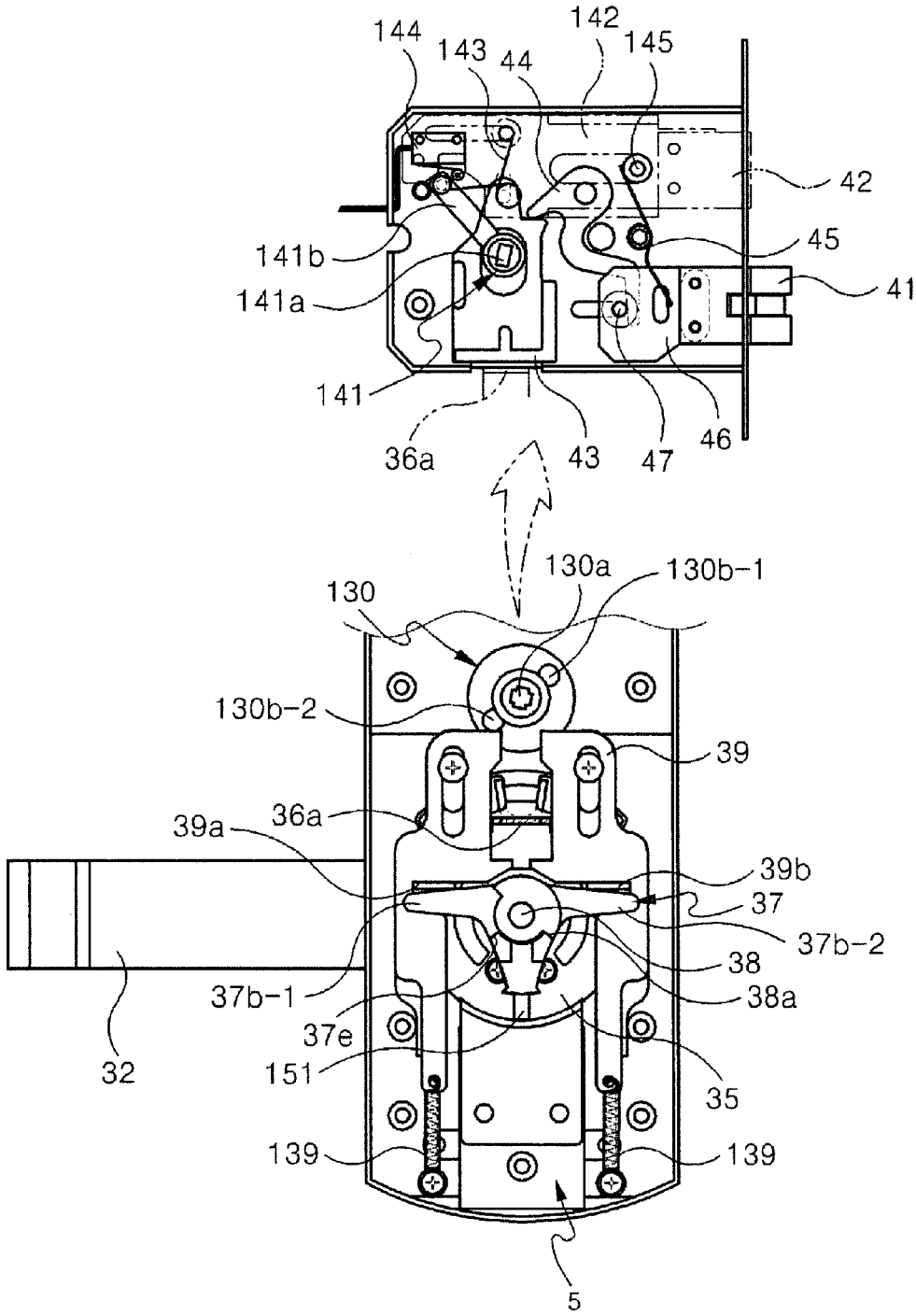
FIG. 12*a* to FIG. 12*d* are plane views showing an operation of an outer unit and a mortise lock illustrating an operation of the dead bolt for locking a door.

2. Description of Operation of Dead Bolt for Locking and Unlocking a Door:

FIG. 12*a* to FIG. 12*d* show plane views showing an operation of the outer unit illustrating an operation of the dead bolt for locking a door. At first, FIG. 12*a* is a plane view showing the outer unit 3 and the mortise lock 4 illustrating that the dead bolt 42 is retracted to unlock the door lock apparatus and the latch bolt 41 is extended outwards, which is substantially identical to the diagram as shown in FIG. 11*a*.

Figure 12B:
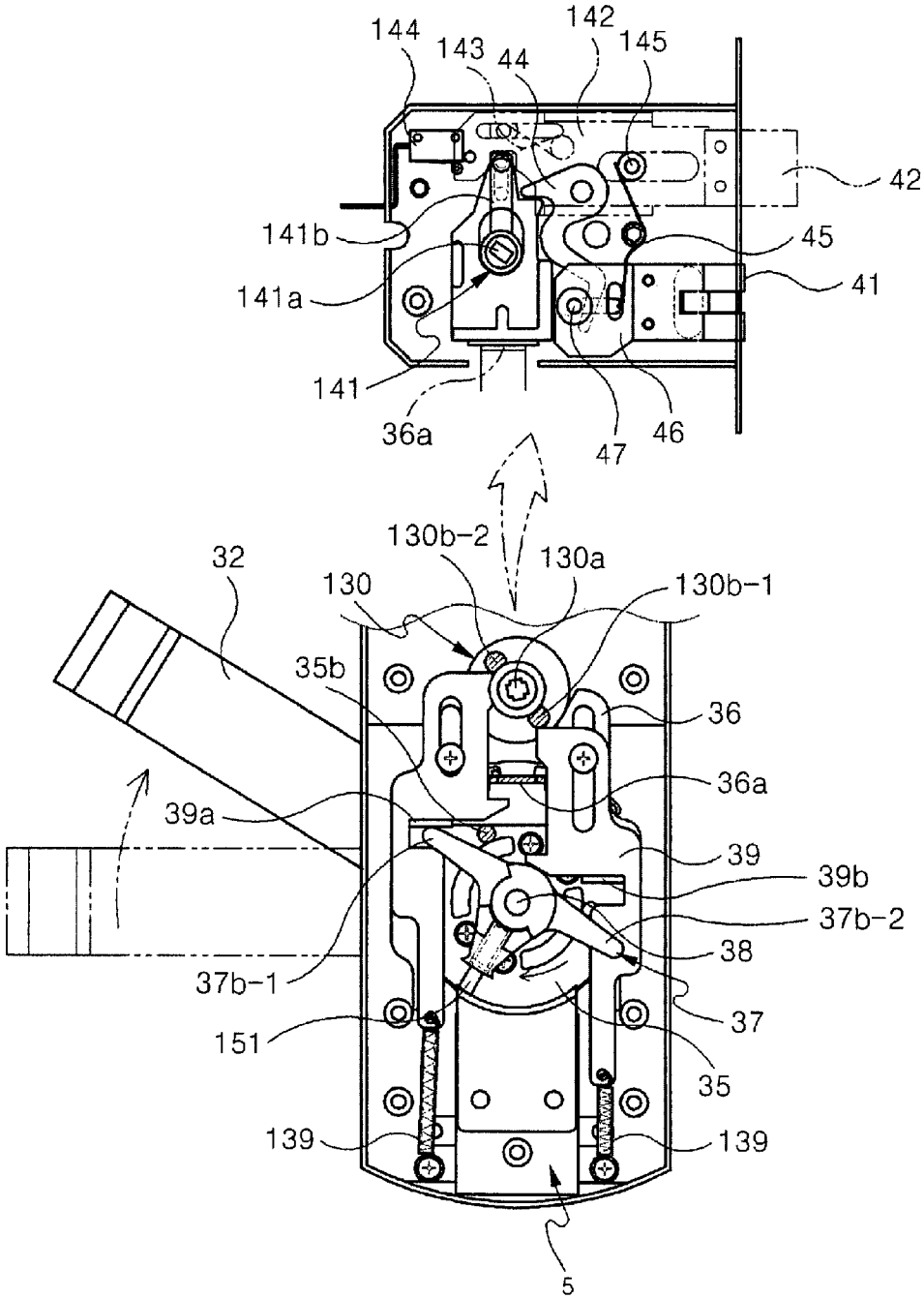

Referring to FIG. 12*b*, if the door handle 32 is pushed upwards under the condition of FIG. 12*a* as shown in FIG. 12*b* (if it is rotated clockwise), a disk 35 fixed in a rotation driver 32*a* of the door handle 32 is rotated in an arrow direction, as described above with reference to FIG. 11*b*. In this case, a first projection 35*a* of the disk 35 as shown in FIG. 7 pushes a free end of an elastic member 34, and a second projection 35*b* of the disk 35 pushes a lift plate 36 upwards, and therefore a protruded plate 36*a* of the lift plate 36 pushes a latch driving slider 43 of the mortise lock 4.

If the latch driving slider 43 is pushed upwards form the condition of FIG. 11*a* as described above, a shoulder portion 43*b* of a slider 43 of the mortise lock 4 pushes one end of a link member 44. Accordingly, the link member 44 is rotated clockwise in the center of a pivot 146, and therefore the other free end of the link member 44 pushes a pin 47 to a left direction, and then a latch bolt 41 is retracted inwards a case of the mortise lock 4, as shown in FIG. 11*b*.

Meanwhile, if the disk 35 is revolved, a shoulder portion 38*a* of a plunger 38, which is inserted into a rectangular through hole 35*d* formed in a central protrusion of the disk 35, is associated with a projection 37*e* of a rotary moving body 37, and therefore the rotary moving body 37 is also rotated together with the disk 35.

Accordingly, when the rotary moving body 37 is rotated, a horizontal wing 37*b*-1 of the rotary moving body 37 pushes a protruded plate 39*a* of a rotating body driving slider 39 upwards, and therefore the key rotating body 130 is rotated by associating an end of the slider 39 with a projection 130*b*-2 of the key rotating body 130 under the condition of FIG. 12*a*, as shown in FIG. 12*b*.

Figure 6:
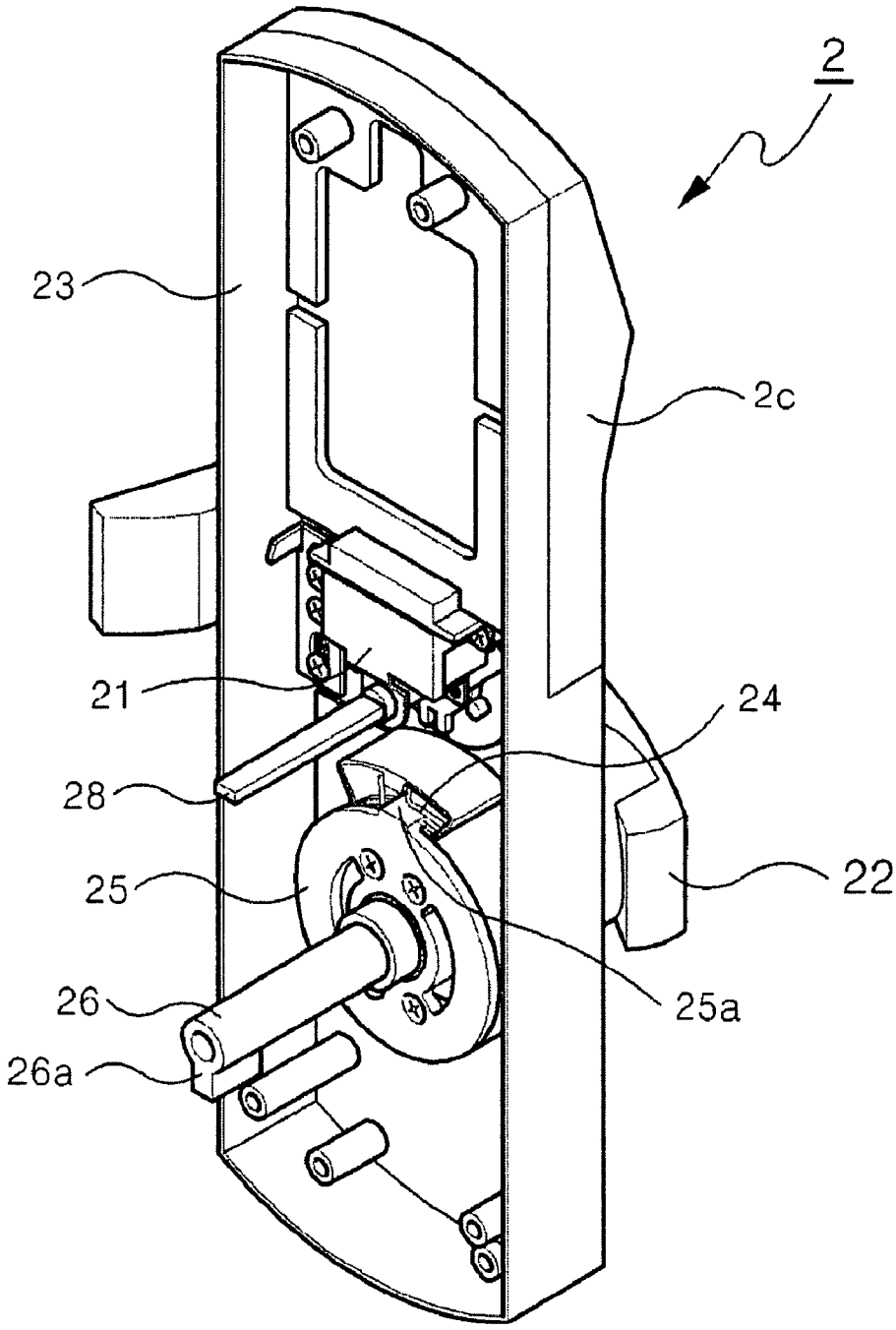
FIG. 6 is a perspective view showing an inner unit used in an embodiment of the present invention.

If the key rotating body 130 is rotated as described above, the plunger 28 as shown in FIG. 6 is rotated, and then the rotation lever 141 of the mortise lock 4 is rotated. Therefore, when the transfer arm 141*b* is rotated under the condition of FIG. 12*a*, as shown in FIG. 12*b*, the dead bolt 42 is extended outwards from the inside of the mortise lock 4 via the dead bolt drive plate 142.

Finally, if the door handle 32 is rotated upwards as shown in FIG. 12*b*, the latch bolt 41 is retracted inwards the mortise lock 4, and the dead bolt 42 remains extended outwards the mortise lock 4.

That is to say, if the internal electronic parts, particularly a motor, is damaged or there is no power source for driving a motor, a door may be locked manually by lifting a door handle 32 upwards without exchanging a dry battery or the motor. Accordingly, ones may be out without anxiety.

However, if a force applied to the door handle 32 is removed when the door handle 32 is pushed upwards as shown in FIG. 12*b*, the free ends of the elastic member 34, which are wide opened as shown in FIG. 7, are contracted, and therefore the first projection 35*a* of the disk 35 is returned to the initial state by means of a restoring force of the free end of the elastic member 34. In this case, the disk 35 is returned to the normal state since it is rotated counterclockwise, as shown in FIG. 12*c*.

If the disk 35 is returned to the normal state as described above, the lift plate 36 moves down by means of a dead weight. At this time, an interfacial portion 36*b* of the lift plate 36 does not further move down since it hangs on a stopper 33*d* formed in the housing 33.

Figure 12C:
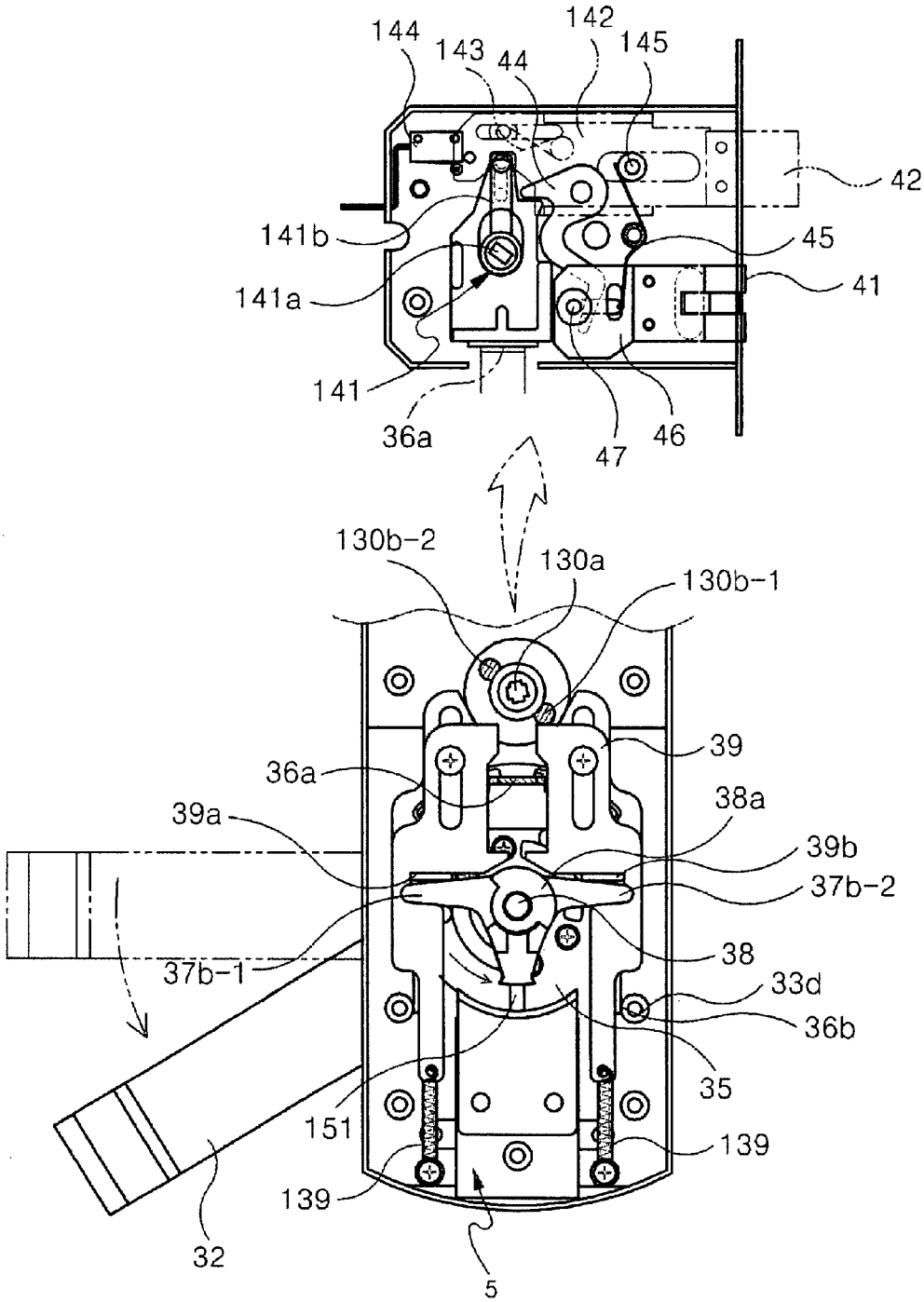

Accordingly, if the disk 35 is returned to the normal state by means of the elastic member 34, the protruded plate 36*a* of the lift plate 36 moves down, and therefore the drive plate 46 of the mortise lock 4 is resiliently operated by means of a restoring force of the elastic member 45, and then the latch bolt 41 is extended inwards the mortise lock 4, thereby to sustain the state of FIG. 12*c*.

Meanwhile, if the disk 35 is rotated counterclockwise, the rotary moving body 37 is also revolved together with the disk 35, and therefore a horizontal wing 37*b*-1 of the rotary moving body 37, which pushed the protruded plate 39*a* of the revolving body driving slider 39 upwards, is returned to the normal state. In this case, the slider 39 is resiliently returned to the normal state as shown in FIG. 12*c* since the extended elastic member 139 is contracted.

The condition of FIG. 12*c* shows that a door is locked. Here, the dead bolt 42 may be unlocked only if the input numbers are identical to a password set inside a door lock, or if a fingerprint recognition system with a fingerprint recognition device is operated when the password is inputted by manipulating various keypads installed inside a cover 3*c* of the outer unit 3.

Figure 12D:
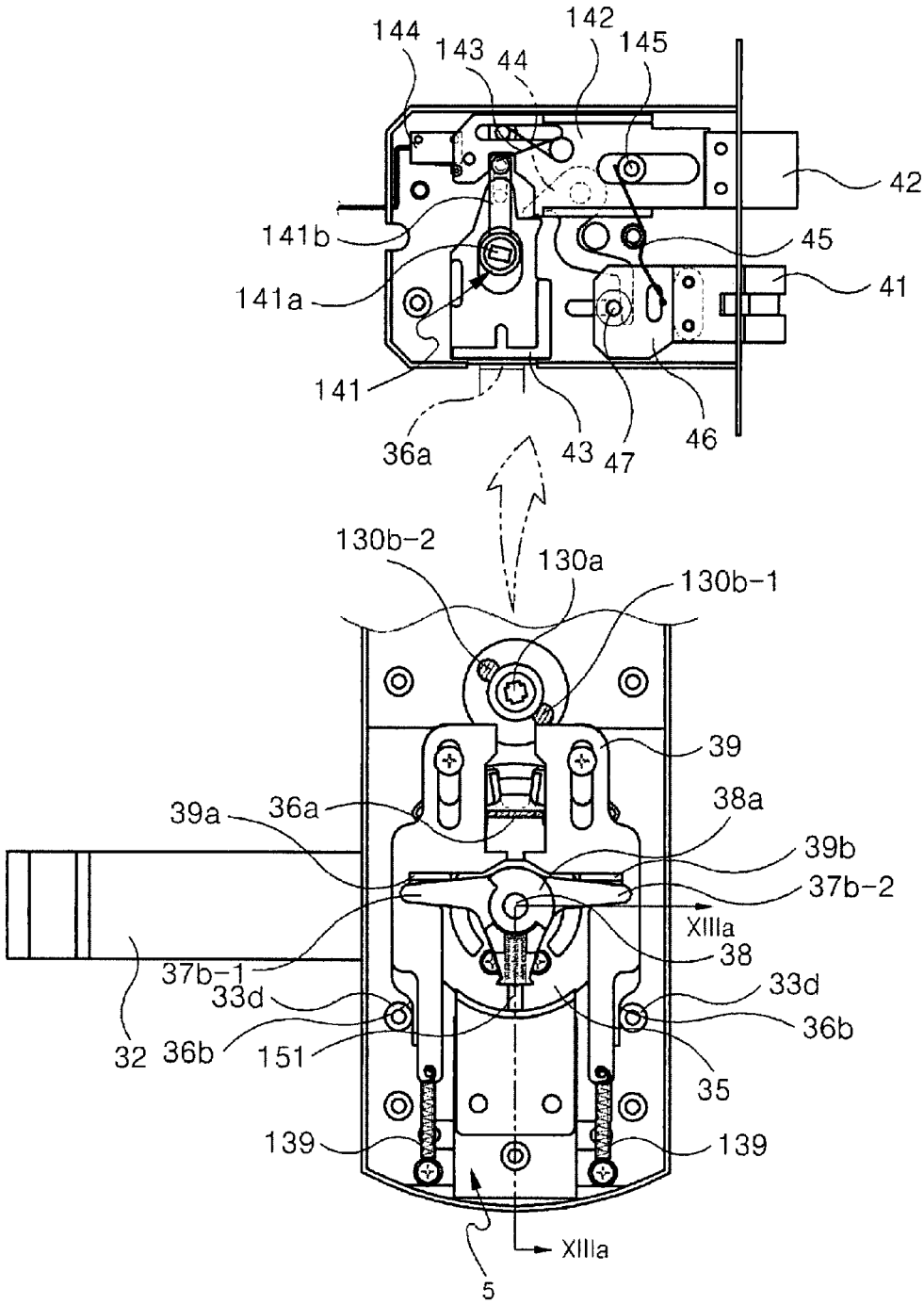
Figure 13A:
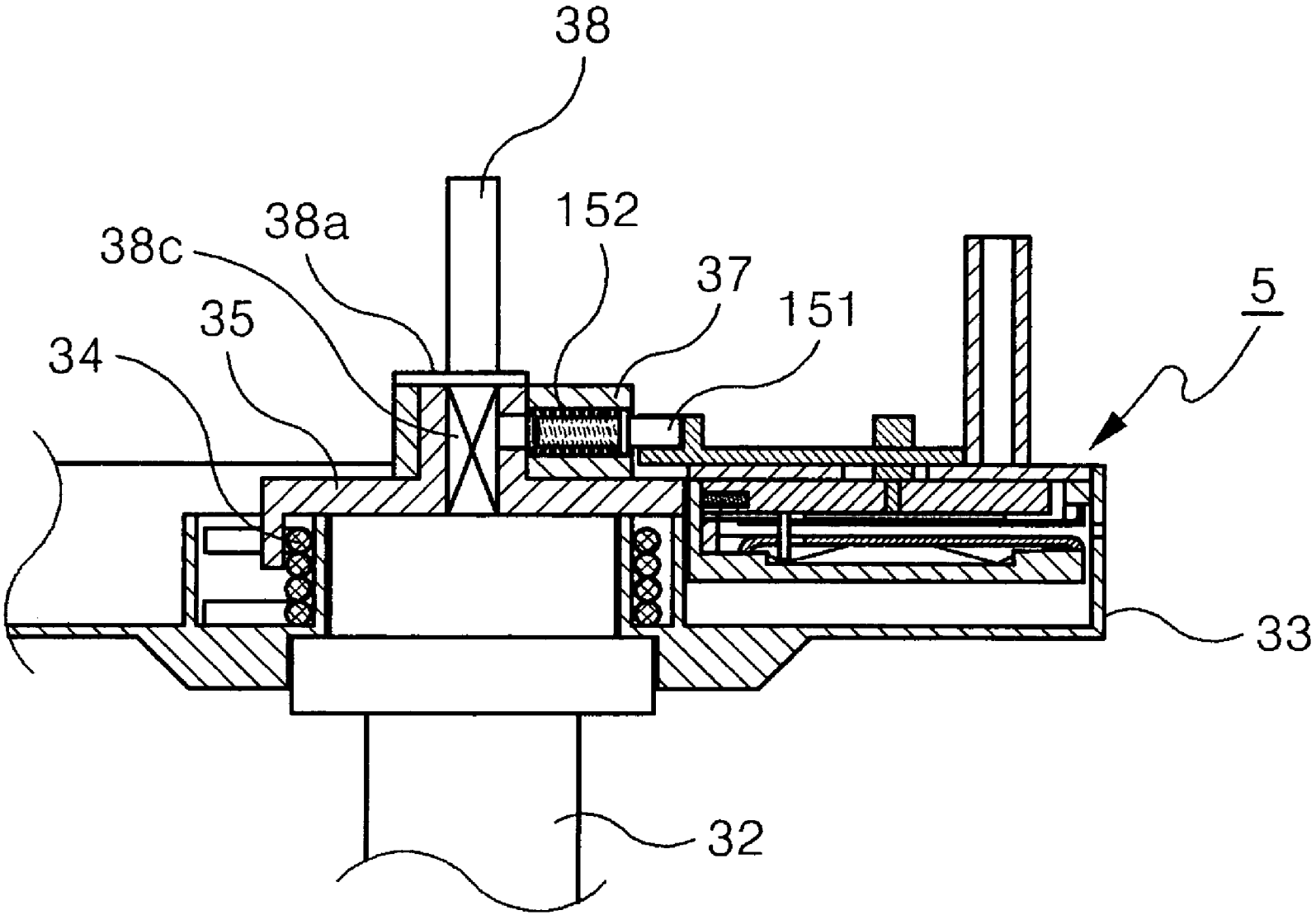
FIG. 13*a* is a cross-sectional view taken from a line XIIIa-XIIIa as shown in FIG. 12*d*.

3. Description of Operation of Dead Bolt for Emergency Release of Door:

Although the door handle 32 of the outer unit 3 moves down under the condition of FIG. 12*c*, a shoulder portion 38*b* of the plunger 38 is not associated with a projection 37*f* of the rotary moving body 37, as shown in FIG. 12*d*. Therefore, on the lift plate 36 ascends, but the rotary moving body 37 is not rotated at all. Accordingly, the dead bolt 42 may not be unlocked from the outside of the door until the plunger 38 and the rotary moving body 37 are artificially integrated with each other (see FIG. 13*a*).

If a door is locked as shown in FIG. 12*c* when an electric current of a dry battery installed in the inner unit 2 flows weakly, it is impossible to unlock the dead bolt 42 as described above even if a door handle 32 of the outer unit 3 is forcibly operated.

Figure 13B:
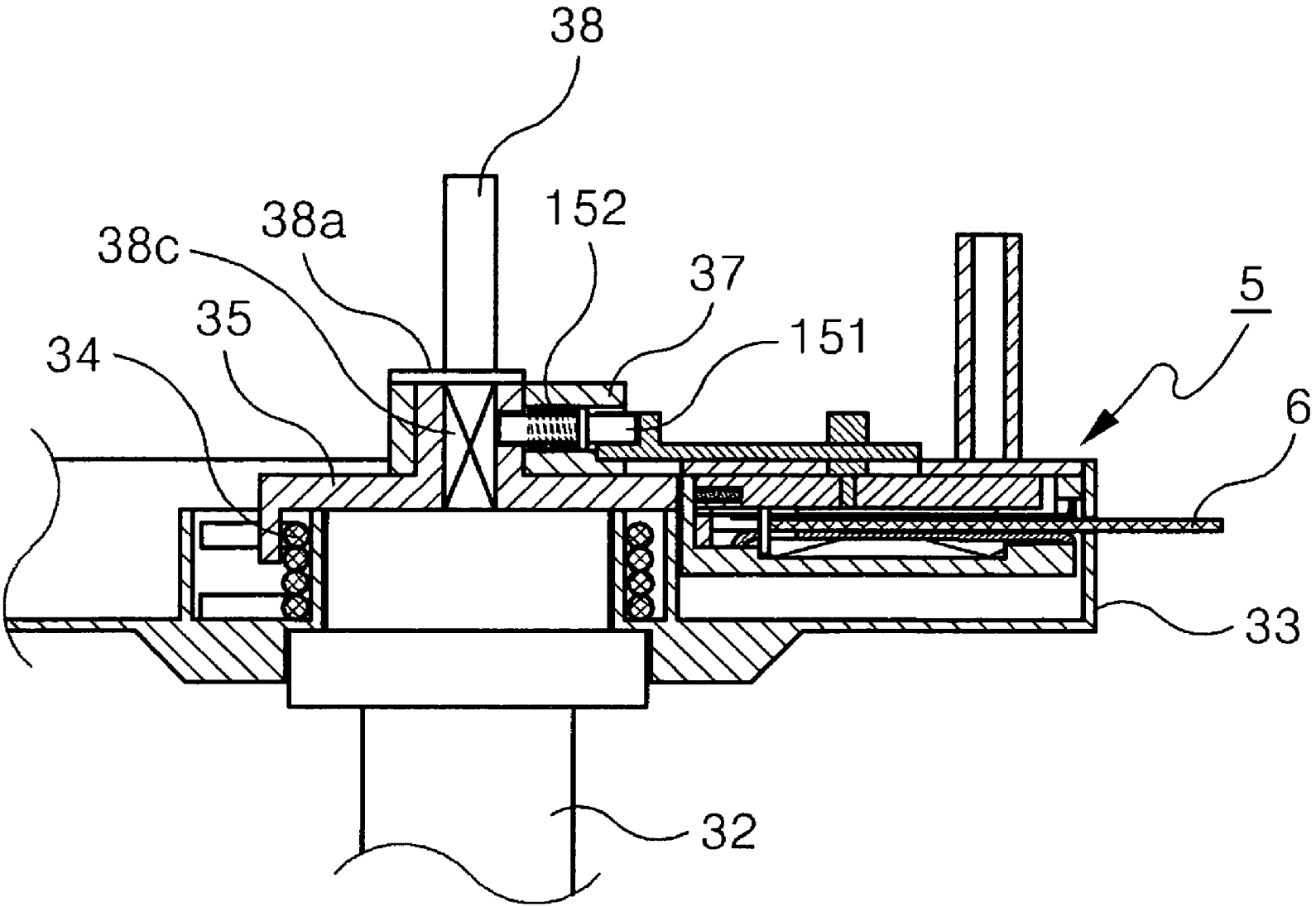
FIG. 13*b* is a cross-sectional view taken from a line XIIIb-XIIIb illustrating an operation of the emergency card as shown in FIG. 12*e*.

Accordingly, the door locking apparatus of the present invention includes an emergency release assembly 5 being able to unlock the dead bolt 42 from the outside of the door 1 by artificially integrating the rotary moving body 37 with the plunger 38 as shown in FIG. 13*b*.

Figure 12E:
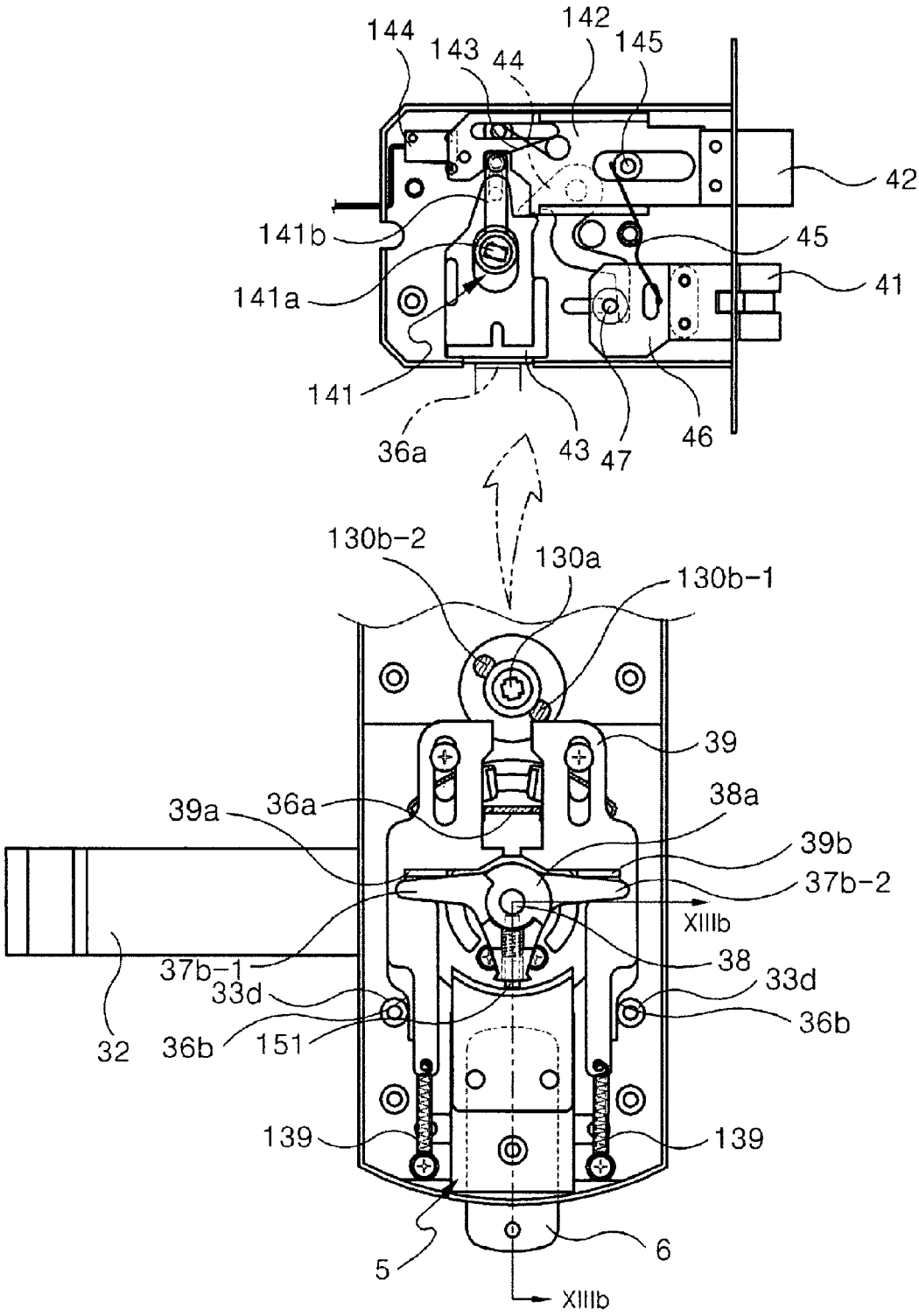
FIG. 12*e* is a plane view showing the outer unit and the mortise lock illustrating that an emergency card is inserted into an emergency release assembly to rotate the key rotating body manually when a power source is turned off under the condition as shown in FIG. 12*c*.

As shown in FIG. 12*e*, if the emergency card 6 is inserted into the emergency release assembly 5, the slider 58 moves toward the rotary moving body 37. At this time, the rotary moving body 37 and the plunger 38 are rotated together when rotating the disk 35 since the locking pin 151 is passed through the inside of the rotary moving body 37, and therefore an end of the slider 39 forcibly rotates a projection 130*b*-1 of the key rotating body 130 since a horizontal wing 37*b*-2 of the rotary moving body 37 pushes a protruded plate 39*b* of the slider 39, thereby to sustain the state as shown in FIG. 13*c*.

Figure 13C:
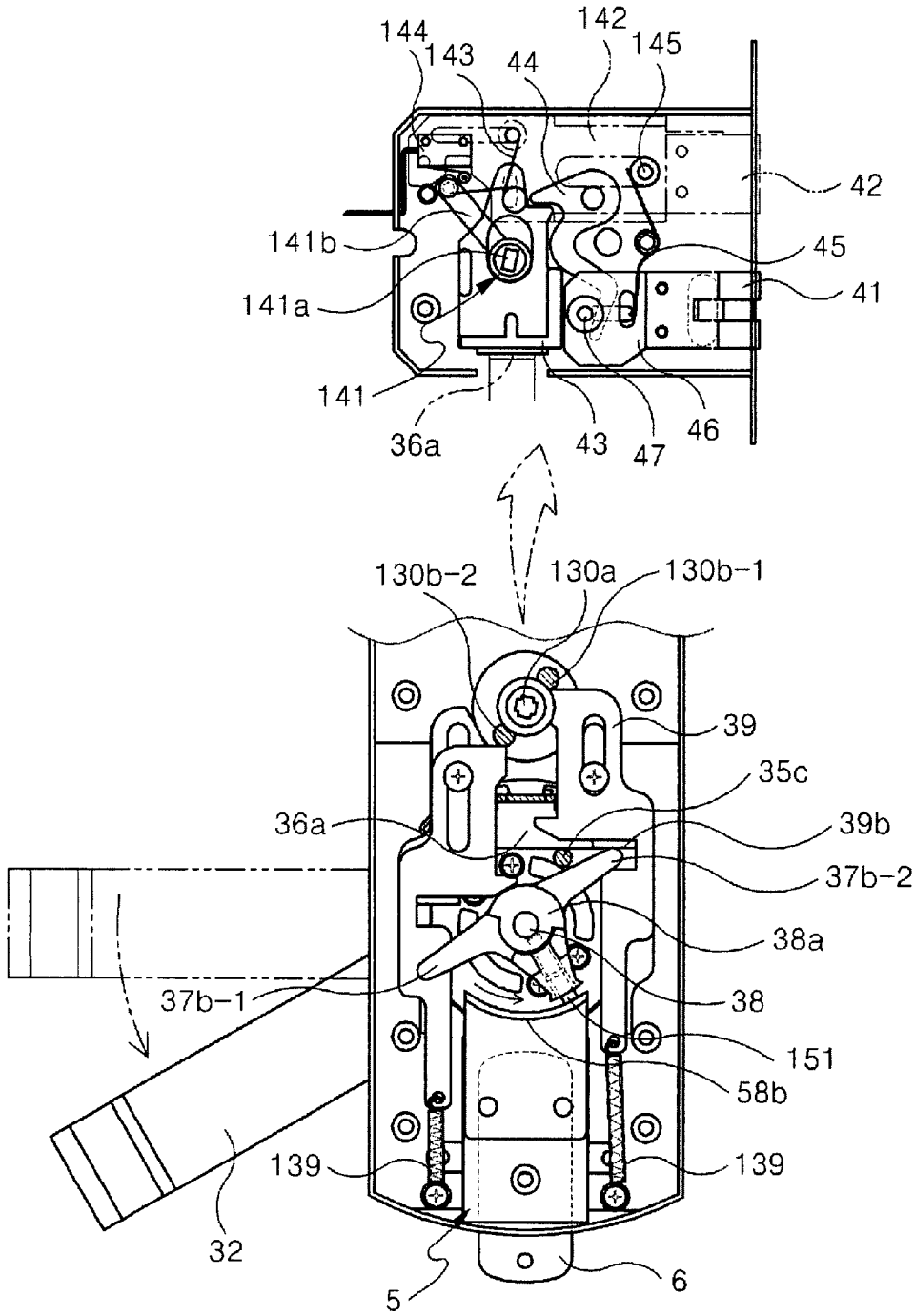
FIG. 13*c* is a plane view showing an outer unit and a mortise lock illustrating that the key revolving body is revolved to unlock a door lock apparatus, and simultaneously the latch bolt is retreated inwards by means of the latch bolt pushing stick if an external force is applied downwards from a door handle of the outer unit when the emergency card is inserted into the door lock apparatus.
Figure 13D:
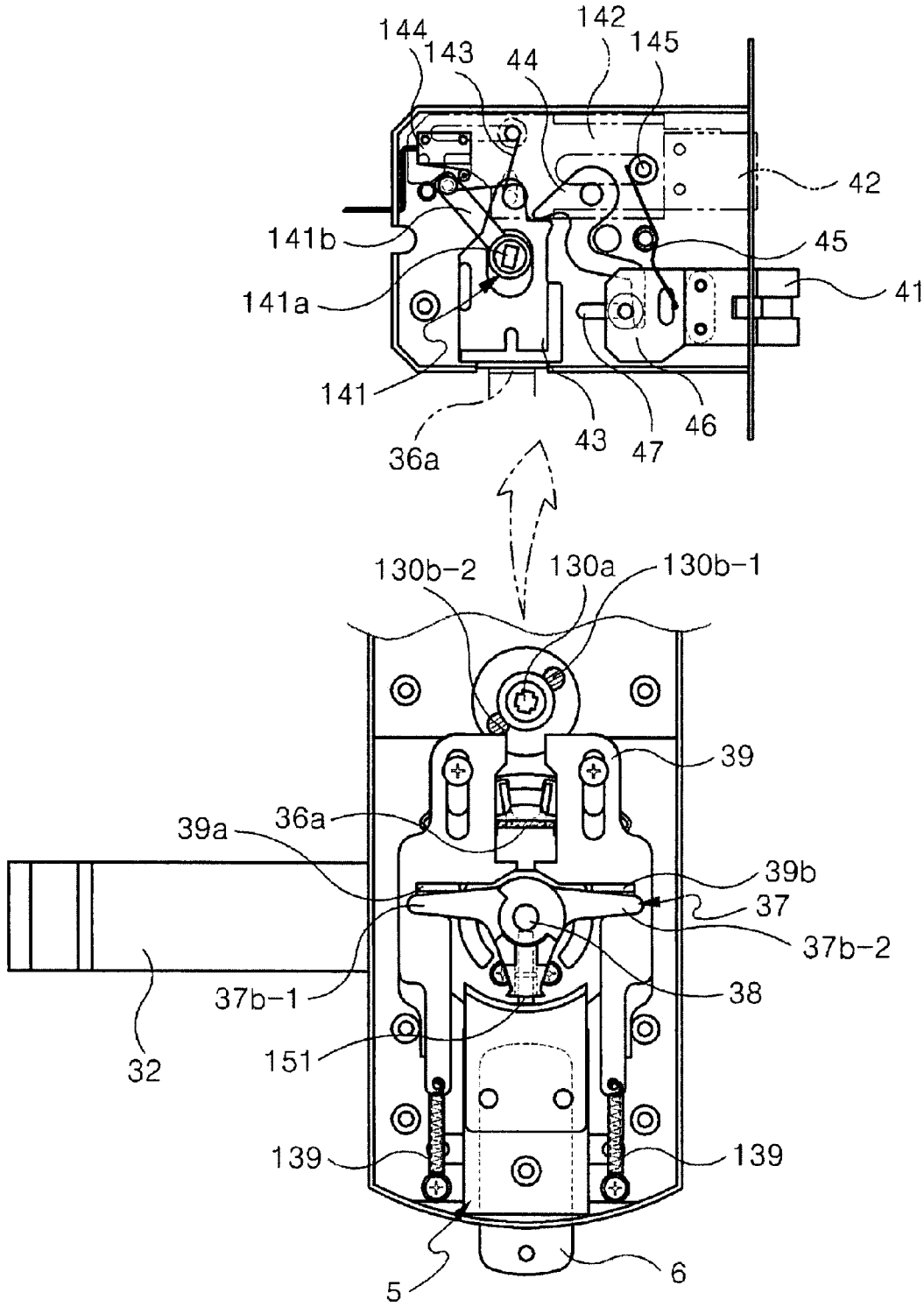
FIG. 13*d* is a plane view showing an outer unit and a mortise lock illustrating that the door lock apparatus is unlocked to return to the normal condition as shown in FIG. 13*a*.

That is to say, if the door handle 32 is rotated as shown in FIG. 13*c* when the emergency card 6 is inserted into the emergency release assembly 5 as shown in FIG. 12*e*, the key rotating body 130 is rotated since the rotary moving body 37 pushes the slider 39 upwards. If the key rotating body 130 is rotated as described above, the plunger 28 as shown in FIG. 6 is rotated, and then the rotation lever 141 of the mortise lock 4 is rotated, and therefore the transfer arm 141*b* is associated from the condition of FIG. 12*e*, as shown in FIG. 13*c*. At this time, the dead bolt 42 may be retracted to unlock a door from the outside of the mortise lock 4 via the dead bolt drive plate 142.

And, if a force applied to the door handle 32 is removed as shown in FIG. 13*c*, the slider 39 may be returned to the normal state by means of a restoring force of the elastic member 139, as shown in FIG. 13*c*.

The emergency release systems of the emergency release assembly 5 and the emergency card 6 will be described in more detail, as follows.

That is to say, referring to an operating system in which the emergency card 6 is inserted into the emergency release assembly 5, as shown in FIG. 12*e*, to allow the slider 58 to operate a locking pin 151, the emergency card 6 is inserted between upper/lower plates 52*a*,52*b*, as shown in FIG. 9. At this time, the emergency card 6 is easily inserted by means of a repulsion against an impact (N/S) of a magnet encoded in the emergency card 6 and an impact of a permanent magnet 56 installed inside a first slider 55. Here, an encoding technique for the magnet repulsion between the permanent magnet 56 and the emergency card 6 is not described herein since the encoding technique has been widely known in the art.

Accordingly, only if an encoding for the emergency card 6 accords with the number and the impact of magnets inserted into the first slider 55 of the emergency release assembly 5, the emergency card 6 is passed between an upper plate 52*a* and a lower plate 52*b*, and then a front end of the emergency card 6 pushes a front end 55*c* extending downwards the first slider 55.

If the first slider 55 moves forwards as described above, a second slider 58 also moves forwards, wherein the second slider 58 is fixed in a hole 55*d* of the first slider 55 using a locking pin 58*a*. At this time, the pushing stick 58*b* pushes a locking pin 151 as shown in FIG. 12*e*, and therefore a pushing stick 58*b* of the second slider 58 is passed between the rotary moving body 37 and the disk 35 so that it can be associated with a rectangular surface 38*c* of the plunger 38, as shown in FIG. 13*b*.

Accordingly, when the plunger 38 is rotated integrally with the disk 35 and the rotary moving body 37, the dead bolt 42 may be unlocked, as shown in FIG. 13*c*.

Accordingly, when a dry battery installed inside the door locking apparatus is nearly dead, or when there are defects in internal control circuits and the like, the door 1 may be opened by unlocking the dead bolt 42 from the outside of the door if the emergency card 6 is inserted into the emergency release assembly 5 and the door handle 32 is then rotated as shown in FIG. 13*c* although the dead bolt 42 remains locked.

Meanwhile, because a projected portion 26*a* of the rotary moving body driving pin 26 in the inner unit 2 installed inside the door 1 is coupled to a reception groove 37*a* of the rotary moving body 37 in the outer unit 3, the door handle 22 may be freely rotated clockwise or counterclockwise, and therefore the latch bolt 41 and the dead bolt 42 of the mortise lock 4 may be locked and unlocked, to thereby open and close the door 1.

Accordingly, the door locking apparatus of the present invention may by useful to ensure safety in opening the door regardless of the components burned or melted in the emergency such as a fire since the door is not opened by the electromotion but mechanically opened in a one-touch system by means of an operation of a lever along with the latch bolt and the dead bolt while one leaves the room.

Also, the door locking apparatus of the present invention may by useful to ensure safety in opening the door by employing a mechanical connection system regardless of automatically opening the door with a barium ferrite emergency card, other than a key, into which a magnetic data is inputted, if a dry battery is dead, or if an electronic function the locking apparatus is out of order due to the defects in the circuits when one enters the room.

The description proposed herein is just a preferable example for the purpose of illustrations only, not intended to limit the scope of the invention, so it should be understood that other equivalents and modifications could be made thereto without departing from the spirit and scope of the invention as apparent to those skilled in the art. Therefore, it should be understood that the present invention might be not defined within the scope of which is described in detailed description but within the scope of which is defined in the claims and their equivalents.

As described above, the door lock apparatus according to the present invention has advantages, as follows. That is to say, 1. Manual Operation Compatible with Electromotion System;

The door is automatically opened by means of the password, the card and the fingerprint, and automatically locked when the door is closed, but the door can be manually closed by rotating the door handle 32 of the outer unit 3 upwards under the worst circumstance such as a malfunction of the door locking apparatus.

2. Panic Open Exit in Leaving Room;

The door can be safely opened regardless of the components burned or melted in the emergency such as a fire since the door is not opened by the electromotion but mechanically opened in a one-touch system by means of an operation of a lever along with the latch bolt and the dead bolt while one leaves the room.

3. Emergency Open Entry;

The door can be safely opened by employing a mechanical connection system regardless of automatically opening the door with a barium ferrite emergency card, other than a key, into which a magnetic data is inputted, if a dry battery is dead, or if an electronic function the locking apparatus is out of order due to the defects in the circuits when one enters the room.

4. Configuration of Metal Structures (Vandal Proop);

Nearly all components except for an insulator are manufactured with strong metal structures that are preventive to a fire and external damages, and particularly the inner unit and the outer unit can have high strength and purity of a natural zinc surface appearance by using a zinc die casting material and process.

5. Easy Operation;

The door locking apparatus of the present invention can be nearly all operated in a one-touch system, and therefore the door can be automatically opened by automatically reading a fingerprint when one touches a door handle, and also automatically opened by automatically reading a RF tag when one touches a door handle while putting on a ring-shaped tag. Also, a fingerprint or a card can be simply inputted from the outside of the door by employing a Command card having a programming function.

6. RF Card System Compatible with Traffic Card (Mifare Contactless Smart Card);

The present invention is characterized in that cards, into which a traffic card or a bank card with a traffic card function is inputted, may be used, and one of a basically provided small emergency card, a sticker-type electronic tag, and a key ring-type electronic tag may be selected and used conveniently.

Although the present invention has been described referring to the accompanying drawings, the present invention is not particularly limited thereto, so it is understood that various changes and modifications may be made in the spirit and scope of the present invention.

For example, the present invention may be applied to a door lock apparatus with a password-entering system, a mechanical door lock apparatus, a door lock apparatus using a card reader, or a door lock apparatus with a fingerprint recognition system.

What is claimed is:

1. A door locking apparatus having an inner unit having a door handle and installed on one of two sides of a door, and an outer unit installed on the other of two sides of the door corresponding to the inner unit and having a door handle, the door locking apparatus comprising:

a mortise lock having a dead bolt extended and retracted by a driving force of a motor installed in the inner unit to lock/unlock the door, and a door locking/unlocking latch bolt operated by the door handles of the inner and outer units;

a latch bolt driver to operate the latch bolt;

a dead bolt driver to drive the dead bolt;

an emergency release assembly installed inside the outer unit and connected to the door handle of the outer unit to unlock a locked dead bolt; and an emergency card inserted into the emergency release assembly to unlock the locked dead bolt.

2. The door locking apparatus according to claim 1, wherein the mortise lock opens/closes the latch bolt, and wherein the mortise lock comprises:

a latch driving slider having a groove slid when the door handles of the inner and outer units are independently rotated and receiving a rotation lever, and a shoulder portion for driving a link member;

the link member contacting the latch driving slider so as to move the latch bolt to open/close the door;

an elastic member for supplying a restoring force to the latch driving slider when moved by the link member;

a drive plate connected to the latch bolt; and a pin fixed to the drive plate and connected to one end of the link member.

3. The door locking apparatus according to claim 1, wherein the mortise lock comprises:

a rotation lever having a hole having a pivot of a plunger retained within the hole to rotate together when being rotated by the motor installed in the inner unit, and a dead bolt transfer arm;

a dead bolt drive plate having one end to which the dead bolt is fixed, and having guide slots and a reception notch unit to receive the dead bolt transfer arm; and an elastic member for supplying a force to drive the dead bolt drive plate when moving the transfer arm.

4. The door locking apparatus according to claim 1, wherein the outer unit comprises a housing having a rotation driver of the door handle retained thereinto and including first and second grooves formed therein, wherein the first groove defines a swivel angle of the door handle, the second groove receiving an elastic member to supply a restoring force to the door handle.

5. The door locking apparatus according to claim 1, wherein the inner unit comprises a housing having a rotation driver of the door handle inserted thereinto and including first and second grooves and a fixed clamp plate, wherein the first groove defines a swivel angle of the door handle, the second groove receiving an elastic member inserted into the second groove to supply a restoring force to the door handle, and the fixed clamp plate having two projections formed therein, the projections defining a swivel angle of a plunger.

6. The door locking apparatus according to claim 1, wherein the latch bolt driver comprises;

a disk having a first projection, two second projections and a rectangular through hole arranged in a central protrusion thereof and including a pinhole for receiving a locking pin, wherein the first projection is fixed in a rotation driver of the outer unit and arranged between both ends of an elastic member to determine a swivel angle of the door handle, the second projections pushing a lift plate upward when rotating the door handle; and the lift plate including a protruded plate to ascend/descend in a vertical direction by the second projections when rotating the disk to push a slider of the mortise lock.

7. The door locking apparatus according to claim 6, wherein the lift plate is returned to a predetermined condition due to a load of the lift plate itself upon being pushed upward by the second projections when rotating the disk, and then returned to the predetermined condition when counter-rotating the disk.

8. The door locking apparatus according to claim 6, wherein the dead bolt driver comprises:

a rotary moving body coupled to the central protrusion of the disk, and prevented from being rotated upon the latch bolt driver being operated by the door handle of the outer unit and rotated at a predetermined angle in one of a left direction and a right direction upon the dead bolt being locked and unlocked, respectively, and including horizontal wings and a vertical groove coupled to a projected portion of a rotating body driving pin of the inner unit;

a plunger including a pivot having a shoulder portion and a rectangular section to rotate the rotary moving body or to prevent the rotary moving body from being rotated upon being inserted into the rectangular through hole of the disk to rotate the door handle;

a key rotating body having a groove and two projections arranged therein, wherein the pivot of the plunger rotated by the motor of the inner unit upon opening/closing the door is inserted into the groove through the mortise lock;

a pair of rotating body driving sliders having protruded plates respectively coupled to the horizontal wings of the rotary moving body upon locking and unlocking the dead bolt; and a pair of elastic members to supply a restoring force to the rotating body driving sliders.

9. The door locking apparatus according to claim 1, wherein the dead bolt driver performs a locking function upon the door handle of the outer unit being rotated upward upon the driving motor being inoprative.

10. The door locking apparatus according to claim 5, wherein the inner unit comprises:

a disk having a projection and a rectangular hole arranged in a central protrusion thereof, wherein the projection is fixed in the rotation driver of the door handle of the inner unit and arranged between both ends of the elastic member to determine a swivel angle of the door handle of the inner unit;

a rotary moving body driving pin having a projected portion and a rectangular projection, wherein the projected portion is rotated upon rotating the disk and is inserted into a vertical groove arranged in a rotary moving body of the outer unit to operate the latch bolt and the dead bolt by operating a lift plate and a rotating body driving slider of the outer unit upon rotating the door handle of the inner unit, and the rectangular projection is inserted into the rectangular hole of the disk; and a plunger to rotate a pair of gears and a rotation lever of the mortise lock together to lock and unlock the dead bolt, wherein the gears are rotated by receiving a driving force of the motor, and the rotation lever is fixed to one of the gears so as to rotate and counter-rotate by a predetermined angle, thereby locking and unlocking, respectively, the dead bolt.

11. The door locking apparatus according to claim 5, wherein the plunger includes a stopper for defining a swivel angle of the plunger in a space between the two projections of the fixed clamp plate.

12. The door locking apparatus according to claim 1, wherein the emergency release assembly comprises:

a body including an opening for inserting the emergency card and a reception groove, and fixed in a housing of the outer unit;

upper and lower plates to facilitate easily inserting the emergency card into the opening of the body;

an elastic plate to resiliently support the upper and lower plates against the body;

a magnet-fixed clamp plate installed onto the upper plate and having through holes arranged therein for receiving a plurality of cylindrical magnets;

a first slider having a plurality of cylindrical grooves and a spring reception groove arranged therein and slid by the emergency card, the cylindrical grooves corresponding to the through holes of the magnet-fixed clamp plate;

a plurality of magnets arranged between the magnet-fixed clamp plate and the first slider to permit the first slider to move only upon a valid emergency card being inserted;

a cover fixed in the body to receive the upper and lower plates, the elastic plate, the magnet-fixed clamp plate, the first slider and the magnets into the reception groove of the body, and simultaneously fixed in the housing and having an opening;

a second slider fixed in the first slider through the opening of the cover and slid to give a bias force to rotate a rotary moving body and a plunger simultaneously; and a rod and a spring inserted into the spring reception groove to provide an elastic force to the first slider.

13. The door locking apparatus according to claim 12, wherein a through hole for receiving a locking pin and a spring is arranged in the rotary moving body; and wherein the rotary moving body is rotated together with the plunger upon the second slider moving forward, and the rotary moving body facilitates the plunger to rotate a rotation lever of the mortise lock by operating a rotating body driving slider to rotate a key rotating body to manually unlock the locked dead bolt.

14. An emergency release assembly connected to a door handle of a door locking apparatus for unlocking a locked dead bolt in response to insertion of an emergency card, said emergency release assembly comprising:

a body including an opening for inserting the emergency card and a reception groove;

upper and lower plates to facilitate easily inserting the emergency card into the opening of the body;

an elastic plate to resiliently support the upper and lower plates against the body;

a magnet-fixed clamp plate installed onto the upper plate and having through holes arranged therein for receiving a plurality of cylindrical magnets;

a first slider having a plurality of cylindrical grooves and a spring reception groove arranged therein and slid by the emergency card, the cylindrical grooves corresponding to the through holes of the magnet-fixed clamp plate;

a plurality of magnets arranged between the magnet-fixed clamp plate and the first slider to permit the first slider to move only upon a valid emergency card being inserted;

a cover fixed in the body to receive the upper and lower plates, the elastic plate, the magnet-fixed clamp plate, the first slider and the magnets into the reception groove of the body, and simultaneously fixed in a housing and having an opening;

a second slider fixed in the first slider through the opening of the cover and slid to give a bias force to rotate a rotary moving body and a plunger simultaneously; and a rod and a spring inserted into the spring reception groove to provide an elastic force to the first slider.

15. The emergency release assembly according to claim 14, wherein a through hole for receiving a locking pin and a spring is arranged in the rotary moving body; and wherein the rotary moving body is rotated together with the plunger upon the second slider moving forward, and the rotary moving body facilitates the plunger to rotate a rotation lever of the mortise lock by operating a rotating body driving slider to rotate a key rotating body to manually unlock the locked dead bolt.

16. A door locking apparatus having an inner unit having a door handle and installed on one of two sides of a door, and an outer unit installed on another of the two sides of the door corresponding to the inner unit and having a door handle, the door locking apparatus comprising:

a mortise lock having a dead bolt extended and retracted by a driving force of a motor installed in the inner unit to lock/unlock the door, and a door locking/unlocking latch bolt operated by the door handles of the inner and outer units; and a latch bolt driver to operate the latch bolt;

said latch bolt driver comprising:

a disk having a first projection, two second projections and a rectangular through hole arranged in a central protrusion thereof and including a pinhole for receiving a locking pin, wherein the first projection is fixed in a rotation driver of the outer unit and arranged between both ends of an elastic member to determine a swivel angle of the door handle of the outer unit, the second projections pushing a lift plate upward when rotating the door handle of the outer unit; and the lift plate including a protruded plate to ascend/descend in a vertical direction by the second projections when rotating the disk to push a slider of the mortise lock.

17. The door locking apparatus according to claim 16, wherein the lift plate is returned to a predetermined condition due to a load of the lift plate itself upon being pushed upward by the second projections when rotating the disk, and then returned to the predetermined condition when counter-rotating the disk.

18. The door locking apparatus according to claim 16, said door locking apparatus further comprising a dead bolt driver for driving the dead bolt, said dead bolt driver comprising:

a rotary moving body coupled to the central protrusion of the disk, and prevented from being rotated upon the latch bolt driver being operated by the door handle of the outer unit and rotated at a predetermined angle in one of a left direction and a right direction upon the dead bolt being locked and unlocked, respectively, and including horizontal wings and a vertical groove coupled to a projected portion of a rotating body driving pin of the inner unit;

a plunger including a pivot having a shoulder portion and a rectangular section to rotate the rotary moving body or to prevent the rotary moving body from being rotated upon being inserted into the rectangular through hole of the disk to rotate the door handle;

a key rotating body having a groove and two projections arranged therein, wherein the pivot of the plunger rotated by a motor of the inner unit upon opening/closing the door is inserted into the groove through the mortise lock;

a pair of rotating body driving sliders having protruded plates respectively coupled to the horizontal wings of the rotary moving body upon locking and unlocking the dead bolt; and a pair of elastic members to supply a restoring force to the rotating body driving sliders.

* * * * *